US010883729B2

(12) United States Patent
Hallit et al.

(10) Patent No.: US 10,883,729 B2
(45) Date of Patent: Jan. 5, 2021

(54) AUTOMATIC FIRING RATE CONTROL FOR A HEAT EXCHANGER

(71) Applicant: Rheem Manufacturing Company, Atlanta, GA (US)

(72) Inventors: Raymond Ibrahim Hallit, Newbury Park, CA (US); Jorge Gamboa, Oxnard, CA (US); Stephen Thomas Thurlkill, Newbury Park, CA (US)

(73) Assignee: Rheem Manufacturing Company, Atlanta, GA (US)

( * ) Notice: Subject to any disclaimer, the term of this patent is extended or adjusted under 35 U.S.C. 154(b) by 406 days.

(21) Appl. No.: 15/851,656

(22) Filed: Dec. 21, 2017

(65) Prior Publication Data

US 2018/0180299 A1 Jun. 28, 2018

Related U.S. Application Data

(60) Provisional application No. 62/438,266, filed on Dec. 22, 2016.

(51) Int. Cl.
*F24D 19/10* (2006.01)
*F24D 3/02* (2006.01)

(52) U.S. Cl.
CPC ..... *F24D 19/1009* (2013.01); *F24D 3/02* (2013.01); *F24D 19/1012* (2013.01); *F24D 19/1048* (2013.01); *F24D 2200/04* (2013.01); *F24D 2220/042* (2013.01); *F24D 2220/044* (2013.01); *F24D 2220/06* (2013.01)

(58) Field of Classification Search
None
See application file for complete search history.

(56) References Cited

U.S. PATENT DOCUMENTS 2,296,598 A * 9/1942 Cook ..... B67D 7/3263 62/50.1
2,668,216 A * 2/1954 Tidd ..... G05D 23/1931 337/397
3,002,359 A * 10/1961 Miner ..... F25B 15/06 62/148

(Continued)

FOREIGN PATENT DOCUMENTS

DE 4210177 A1 * 10/1992 ..... F24H 1/40

OTHER PUBLICATIONS

"Handbook of Air Conditioning and Refrigeration, 2nd Ed."; Wang, Shan K.; McGraw-Hill; pp. 7.4-7.5, 8.13; 2001.*

(Continued)

*Primary Examiner* — Steven B McAllister
*Assistant Examiner* — Daniel E. Namay
(74) *Attorney, Agent, or Firm* — Troutman Pepper Hamilton Sanders LLP

(57) ABSTRACT

A heat exchanger includes a burner configured to burn a combustible gas to produce heat, a heat exchanger configured to receive the heat from the burner, a flow sensor configured to measure a flow rate of a coolant passing through the heat exchanger; and a controller comprising processing circuitry. The processing circuitry receives flow data from the flow sensor and controls a firing rate of the burner based on a predetermined relationship between a differential temperature of coolant flowing through the heat exchanger and the coolant's flow rate.

30 Claims, 9 Drawing Sheets

(56) References Cited

U.S. PATENT DOCUMENTS 3,236,299 A * 2/1966 Smith, Jr. ..... F22D 11/00 165/134.1
5,826,647 A * 10/1998 Engelhardt ..... C09C 1/50 165/134.1
2008/0216771 A1* 9/2008 Paine ..... F24D 19/1009 122/14.2
2012/0118249 A1* 5/2012 Rohs ..... F01L 1/462 123/56.1
2012/0118261 A1* 5/2012 Rohs ..... F23D 11/446 123/216
2012/0118272 A1* 5/2012 Rohs ..... F02B 75/26 123/51 A
2012/0145120 A1* 6/2012 Rohs ..... F02B 75/26 123/204
2013/0248609 A1* 9/2013 Aspeslagh ..... F24D 12/02 237/8 A
2014/0202680 A1* 7/2014 Kusachi ..... F24H 1/145 165/287
2014/0229022 A1* 8/2014 Deivasigamani .... G05D 7/0629 700/282
2015/0253035 A1* 9/2015 Naitoh ..... F24H 1/145 122/18.4
2016/0047558 A1* 2/2016 Shimada ..... F24D 19/1069 237/8 A
2016/0238261 A1* 8/2016 Lyhne ..... F24D 19/1054
2016/0320094 A1* 11/2016 Madeira ..... F24H 7/0466
2017/0108242 A1* 4/2017 Hamagami ..... F24H 9/2035
2017/0130971 A1* 5/2017 Wilson ..... F24D 19/1009
2017/0205115 A1* 7/2017 Ng ..... F23N 1/00
2017/0219219 A1* 8/2017 Miller ..... F24D 3/02
2017/0363301 A1* 12/2017 Son ..... F24H 1/34
2018/0073748 A1* 3/2018 Gagne ..... F24H 9/2035
2018/0073749 A1* 3/2018 Gagne ..... F24D 3/08
2018/0245800 A1* 8/2018 Darko ..... F22B 1/18
2018/0266703 A1* 9/2018 Guilherme ..... F24D 19/1021

OTHER PUBLICATIONS

"DE_4210177_A1_M—Machine Translation.pdf", machine translation, WIPO.int., Aug. 6, 2020.*

* cited by examiner

AUTOMATIC FIRING RATE CONTROL FOR A HEAT EXCHANGER

CLAIM OF PRIORITY

This application claims priority to U.S. Provisional Application No. 62/438,266, filed Dec. 22, 2016, the entire disclosure of which is incorporated by reference herein.

FIELD OF THE INVENTION

The present invention relates generally to heat exchangers. More specifically, embodiments of the present invention relate to controlling firing rate of a burner of the heat exchanger.

BACKGROUND OF THE INVENTION

Typical heat exchangers are used to transfer heat from a first fluid and a second fluid, such as from a hot combustion gas to water, etc. A typical heat exchanger includes a plurality of elongated, cylindrically-shaped heat exchanger tubes that are disposed within a shell and are substantially parallel to the shell's longitudinal center axis. In a basic heat exchanger, the heat exchanger tubes may make only one pass through the shell. However, in more complex heat exchangers, the heat exchanger tubes may make multiple passes within the shell. A combustion chamber in which hot gasses are produced by the combustion of fuels is provided at a first end of the shell. A blower may be used to move the hot combustion gasses through the plurality of heat exchanger tubes from the first end to the second end of the shell, thereby passing through the portion of the shell in which the second fluid, e.g. coolant, is contained. The heat exchanger is provided with an inlet for the coolant, as well as an outlet that allows the coolant to exit the heat exchanger after the heating process. The coolant is defined as the fluid medium receiving heat from the heat exchanger; this medium may comprise water or a solution of water and other additives, such as glycol and corrosion inhibitor, or the like.

Over the life of the heat exchanger, multiple ignition sequences and cycling of the heat exchanger may cause degradation of its internal components. In some instances, a heat exchanger may be operated under undesirable conditions, such as low flow at high firing rate, which may cause stress to the internal components of the heat exchanger, thus reducing the device's overall performance and/or life. However, under recommended operation conditions and proper maintenance programs, the life of the heat exchanger may be significantly extended.

In known configurations of boilers, the boiler can be controlled automatically from a remote device that, under predetermined conditions, sends a signal to a controller at the boiler, requesting that the boiler contribute heat to the coolant (e.g. water). The remote device may be a thermostat that sends signals to the boiler in response to conditions ambient to the thermostat, or it may be a device controlled by a system to which the boiler outputs the heated coolant, or it may be a user controlled device. In any of these instances, the signal from the remote device may include a target temperature at which the boiler is to provide the heated coolant. The boiler also includes a temperature sensor at the coolant line as it exits the boiler or at some point downstream from the boiler's coolant exit. The temperature sensor sends its output signal, which indicates the temperature of the out-flowing coolant, to the boiler controller.

If the boiler controller receives the remote device signal when the boiler is inactive, the controller first confirms that all of one or more predetermined safety-related conditions exist and, if so, ignites the burner and controls a blower that moves fuel gas to the burner at a predetermined speed that is less than the blower's maximum speed, thereby setting the burner at a predetermined firing rate that is less than the burner's maximum possible firing rate. The boiler controller also actuates a system pump that moves the coolant through the boiler. Upon detecting that that burner has ignited from the signal from a flame sensor proximate the burner, the boiler controller monitors the temperature sensor signal and compares the coolant temperature to the target temperature provided by the remote device. If the actual coolant temperature from the temperature sensor signal is below the target temperature, the boiler controller increases the blower, thereby setting the burner to a maximum firing rate that is set within the controller programming, and continues to monitor the signal output by the temperature sensor. The maximum firing rate is a constant value. When the actual temperature rises to a predetermined increment below the target temperature, the controller reduces the blower's speed to reduce the amount of heat contributed directly by the burner. The coolant continues, however, to receive heat from the burner's exhaust gas and from residual heat already in the heat exchanger tubes. When the temperature sensor signal indicates that the coolant temperature has reached the target temperature, the boiler controller deactivates the burner (via control of a valve in the fuel gas line to an off position). The controller also deactivates the blower, after expiration of a period of time sufficient to purge remaining combustion gases. While the remote device continues to require heated coolant, the boiler controller continues to maintain the coolant pump in an activated state and continues to monitor the coolant temperature. If coolant temperature drops below a predetermined value (below the target temperature, to prevent over-cycling), the controller reactivates the burner (at the predetermined firing rate discussed above), and the cycle proceeds as described above. If the boiler controller receives a signal from the remote device indicating the need for heated coolant has ended, the boiler controller deactivates the burner and the system/coolant pump and awaits the next heat request signal. It will be understood that blower architectures vary. For example, certain boilers have variable speed blowers that, through control of blower speed, can control the rate at which combustion and contribution of heat from resulting combustion gases occur. Boilers may also include multiple sections of burners that can be individually controlled to active and inactive states.

The accompanying drawings, which are incorporated in and constitute a part of this specification, illustrate one or more embodiments of the invention and, together with the description, serve to explain the principles of the invention.

SUMMARY OF THE INVENTION

The present invention recognizes and addresses considerations of prior art constructions and methods.

In an example embodiment, a target differential temperature of coolant across predetermined positions in the coolant's flow path through the heat exchanger (DT), e.g. a boiler, may be automatically controlled as a function of coolant flow through the heat exchanger and, in some embodiments, coolant specific heat. A controller may be configured to control a firing rate of a burner of the heat exchanger against a maximum allowable firing rate that is based on a predetermined relationship between DT and flow rate of coolant within the path of coolant flow in the heat exchanger. In an example embodiment, a flow sensor may be added to the heat exchanger. A flow measurement from the flow sensor may be used as an input to an intelligent algorithm, which may allow the unit to automatically adjust the maximum allowable firing rate, enabling increased performance to improve system operation and to extend the heat exchanger system's life.

In one or more embodiments, a heat exchanger system has a burner configured to burn a combustible gas to produce heat, a heat exchanger configured to receive the heat from the burner and transfer the heat to a coolant flowing through the heat exchanger, and a flow sensor disposed with respect to the heat exchanger to measure flow rate of the coolant through the heat exchanger. A controller includes processing circuitry configured to receive data from the flow sensor indicative of the flow rate and, after an initial ignition of the burner, control a firing rate of the burner based on a predetermined relationship between a temperature difference of the coolant across predetermined positions in the coolant's flow path through the heat exchanger (DT) and the flow rate, in which DT varies with the flow rate. In one or more embodiments, the predetermined relationship is linear. In one or more embodiments, the predetermined relationship is based on an efficiency of the heat exchanger, a first predetermined heat input rate to the heat exchanger at a first predetermined flow rate of the coolant, and a second predetermined heat input rate to the heat exchanger at a second predetermined flow rate of the coolant.

In one or more embodiments, a method of controlling operation of a heat exchanger system having a burner configured to burn a combustible gas to produce heat, a heat exchanger configured to receive the heat from the burner and transfer the heat to a coolant flowing through the heat exchanger, and a flow sensor disposed with respect to the heat exchanger to measure flow rate of the coolant through the heat exchanger includes receiving data from the flow sensor indicative of the flow rate and, after an initial ignition of the burner, controlling a firing rate of the burner based on a predetermined relationship between a temperature difference of the coolant across predetermined positions in the coolant's flow path through the heat exchanger (DT) and the flow rate, in which DT varies with the flow rate. In one or more embodiments, the predetermined relationship is linear. In one or more embodiments, the predetermined relationship is based on an efficiency of the heat exchanger, a first predetermined heat input rate to the heat exchanger at a first predetermined flow rate of the coolant, and a second predetermined heat input rate to the heat exchanger at a second predetermined flow rate of the coolant.

The accompanying drawings, which are incorporated in and constitute a part of this specification, illustrate one or more embodiments of the invention and, together with the description, serve to explain one or more embodiments of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
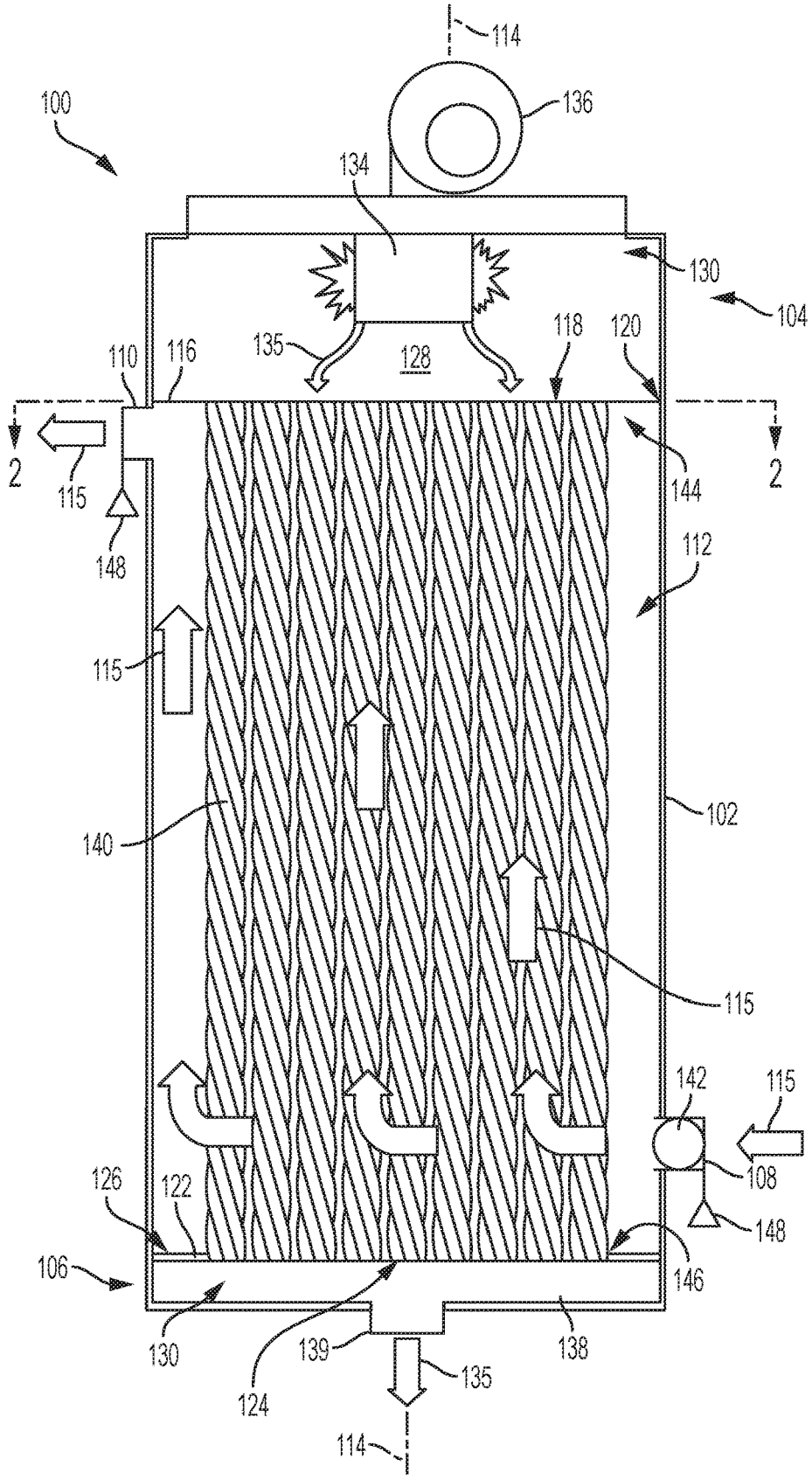
FIG. 1 illustrates a partial cross-sectional view of a heat exchanger including a plurality of heat exchanger tubes in accordance with an example embodiment.

Repeat use of reference characters in the present specification and drawings is intended to represent same or analogous features or elements of the invention according to the disclosure.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
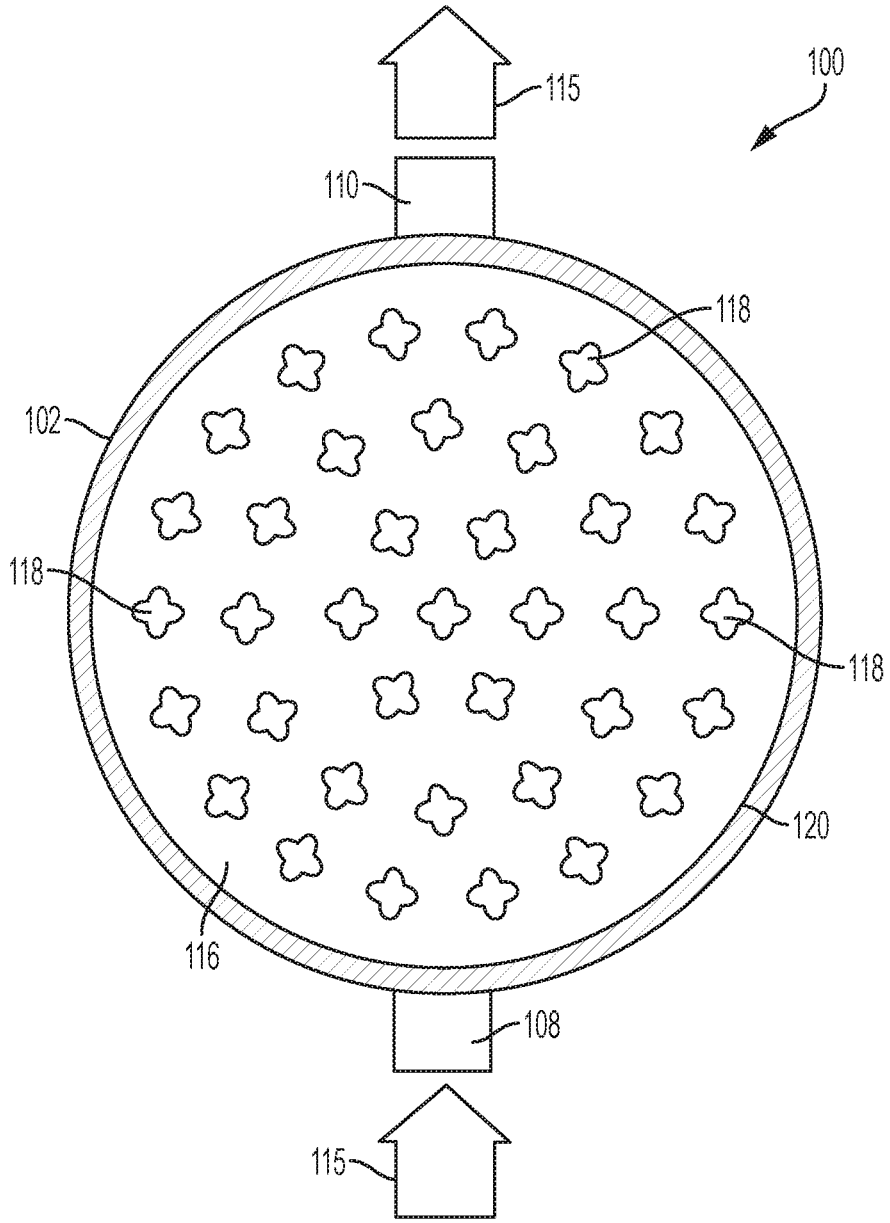
FIG. 2 illustrates a cross-sectional view of the heat exchanger shown in FIG. 1, taken along line 2-2 according to an example embodiment.

As used herein, terms referring to a direction or a position relative to the orientation of the heat exchanger, such as but not limited to "vertical," "horizontal," "upper," "lower," "above," or "below," refer to directions and relative positions with respect to the heat exchanger's orientation in its normal intended operation, as indicated in FIGS. 1 and 2 herein. Thus, for instance, the terms "vertical" and "upper" refer to the vertical direction and relative upper position in the views of FIG. 1 and should be understood in that context, even with respect to a heat exchanger that may be disposed in a different orientation.

Further, the term "or" as used in this disclosure and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provided illustrative examples for the terms. The meaning of "a," "an," and "the" may include plural references, and the meaning of "in" may include "in" and "on." The phrase "in one embodiment," as used herein does not necessarily refer to the same embodiment, although it may.

Example Heat Exchanger

Referring now to FIGS. 1 and 2, a heat exchanger 100 may be provided, for example a fire-tube boiler, including a vertically oriented, generally cylindrical shell 102, a first end plate 116 disposed within a first end 104 of shell 102 and a second end plate 122 disposed in a second end 106 of shell 102. The heat exchanger 100 may also include a plurality of elongated heat exchanger tubes 140 disposed within shell 102, such that the elongation dimensions of the tubes 140 are all substantially parallel to the elongation dimension (e.g. a longitudinal or symmetrical center axis) 114 of heat exchanger 100 (and, more particularly, to the elongation direction or center axis of a volume of the enclosed tank defined by shell outer wall 102 and end plates or walls 116 and 122). A combustion chamber 128 may be disposed in first end 104 of shell 102, and may be defined in part by first end plate 116. A burner 134 may be disposed within combustion chamber 128, and a blower 136 may be in fluid communication with combustion chamber 128. An outlet chamber 138 may be disposed within second end 106 of shell 102, and formed in part by second end plate 122. The plurality of heat exchanger tubes 140 may allow fluid communication between combustion chamber 128 and outlet chamber 138. Note, in alternate embodiments, heat exchanger 100 may be oriented such that its longitudinal or symmetrical center axis 114 is substantially horizontal rather than substantially vertical. The geometry of the heat exchanger tubes 140 may be round, oval, square, star shaped, or the like. Additionally or alternatively, the heat exchanger tubes 140 may be defined along a straight axis or a curved or wave-like axis, and/or may have smooth surfaces or have surfaces that are dimpled, twisted, crimped, or formed in a variety of shapes.

First end plate 116 may define a plurality of entry apertures 118. The shape of each entry aperture 118 may be configured to correspond with the cross-section of an end of a corresponding heat exchanger tube 140. As shown, each entry aperture 118 may be considered to be defined by the intersection of the end plate and a tube end. As noted, each aperture 118 may correspond to the cross-sectional shape of the heat exchanger tube 140 that is attached (e.g. by laser welding) at the aperture 118 at the first end plate 116 through which the aperture extends so that the internal volume of the heat exchanger tube 140 may be in fluid communication with the aperture 118.

Referring to FIG. 1, a first end 144 of each heat exchanger tube 140 may be secured to a corresponding entry aperture 118 of first end plate 116, such as by laser welding, in a fluid-tight manner. Similarly, a second end 146 of each heat exchanger tube 140 may be secured in alignment with a corresponding exit aperture 124 (which may or may not have the same shape as aperture 118) of second end plate 122, such as by laser welding, in a fluid-tight manner. Additionally, the first end plate 116 and second end plate 122 each may include an outer perimeter 120 and 126, respectively that may be secured to an inner surface of shell 102 in a fluid-tight manner. As such, first end plate 116, second end plate 122, and the portion of shell 102 disposed therebetween may define a first volume 112 that may be configured to receive a first fluid, e.g. coolant, such as, but not limited to, water, water/glycol solution, or the like, therein. Similarly, combustion chamber 128, outlet chamber 138, and heat exchanger tubes 140 may define a second volume 130 that is configured to receive a second fluid, such as, but not limited to, combustion gasses, therein.

Referring again to FIGS. 1 and 2, operation of heat exchanger 100, for example a fire-tube boiler, may cause heat to be transferred to the coolant that may pass through first volume 112 of shell 102 from a second fluid that may pass through the plurality of heat exchanger tubes 140. The first fluid, e.g. a coolant such as water, may flow into shell 102 and volume 112 at inlet 108, pass over the outer surfaces of the plurality of heat exchanger tubes 140 that extend through first volume 112, and ultimately flow out of shell 102 through outlet 110. The flow of coolant into, through, and out of first volume 112 of shell 102 is represented by flow arrows 115. Note, multiple inlets 108 and outlets 110 may be provided on shell 102 for the ingress and egress of coolant. Simultaneously, the second fluid, e.g. hot combustion gas generated by combustion at burner 134, may be propelled through second volume 130, which may be defined by combustion chamber 128, the inner volume of heat exchanger tubes 140, and outlet chamber 138. To achieve the desired flow of the second fluid, which in the instant case is a hot combustion gas, a fuel may be combusted in combustion chamber 128. Fuels such as, but not limited to, natural gas from a natural gas line or other source in communication with burner 134 may be used. The resultant hot combustion gasses may be moved from combustion chamber 128 through the plurality of heat exchanger tubes 140 by blower 136. As should be understood, the heat exchange rate between the combustion gas and the tube wall, and therefore between the combustion gas and the coolant within the tank volume, may increase or decrease directly with increases and decreases in the speed at which the gas moves through the tubes, e.g. a mass flow rate of the combustion gasses. Thus, blower 136 may be operated to achieve a desired heat transfer rate between the hot combustion gasses in second volume 130 and the coolant passing over the heat exchanger tubes 140 in first volume 112. In other embodiments, the burner is configured in stages, in which each stage has a fuel supply, air supply (or mixed fuel/air supply) and an independent igniter/flame sensor set, that can be independently ignited and deactivated to control firing rate. That is, for example assuming five burner segments, none, one, two, three, four, or five burner segments can be ignited, each independently of the other, to respectively define 0%, 20%, 40%, 60%, 80%, and 100% of the maximum firing rate. It will be understood from the present disclosure that firing rate may be controlled via selective control of burner segments instead of, or in addition to, control of blower speed. In embodiments in which firing rate is controlled through independent burner segment control, the firing rate is limited by the maximum operational firing rate, as described below. A P-I-D controller may actuate as many of the five burner segments as needed to get as close to a desired firing rate as possible (given the six possible discrete firing rate levels), without exceeding the maximum operational firing arte. If, for instance, the maximum operational firing rate defined by the equations below is 67% and the P-I-D-defined desired firing rate is 80%, the controller activates no more than three of the five burner segments. If the desired firing rate is 60% and the maximum operational firing rate is 90%, the controller activates three segments. If the maximum operational firing rate is 18%, the controller deactivates all burner segments.

In the example embodiment depicted in FIG. 1, the flow direction of coolant, as indicated by arrow 115 is substantially counter to that of the combustion gasses, as indicated by arrow 135, that moves downwardly through the heat exchanger tubes 140. After passing through heat exchanger tubes 140, the hot combustion gasses exit heat exchanger 100 by way of outlet 139 of outlet chamber 138.

In some example embodiments, heat exchanger 100 may include one or more flow sensors 142. Flow sensors 142 may be disposed at inlet 108 of the first volume 112 and be configured to measure a flow rate, such as volumetric or mass flow rate, of the coolant that passes through heat exchanger 100. In an example embodiment, in which heat exchanger 100 includes multiple inlets 108, heat exchanger 100 may include a flow sensor 142 for each inlet 108. The volumetric flow rate may be summed at one of the flow sensors 142 or at a controller, as discussed below. Additionally or alternatively, flow sensor 142 may be disposed at any position in the coolant system, which is hydraulically closed with the heat exchanger 100, such that the flow rate measured by the one or more flow sensors 142 is indicative of the total flow rate of the coolant through the heat exchanger.

In an example embodiment, the heat exchanger 100 may also include one or more temperature sensors 148 disposed at both inlet 108 and outlet 110 of heat exchanger 100. Temperature sensors 148 may be configured to measure the inlet temperature of the coolant as the coolant enters heat exchanger 100 and the outlet temperature as the coolant exits outlet 110 of the heat exchanger 100. Temperature sensors 148 may be utilized to determine a differential temperature across heat exchanger 100.

The fire tube boiler depicted in FIG. 1 is provided as an example heat exchanger 100. One of ordinary skill in the art, however, should understand from the present disclosure that other heat exchanger configurations may be used.

Figure 7:
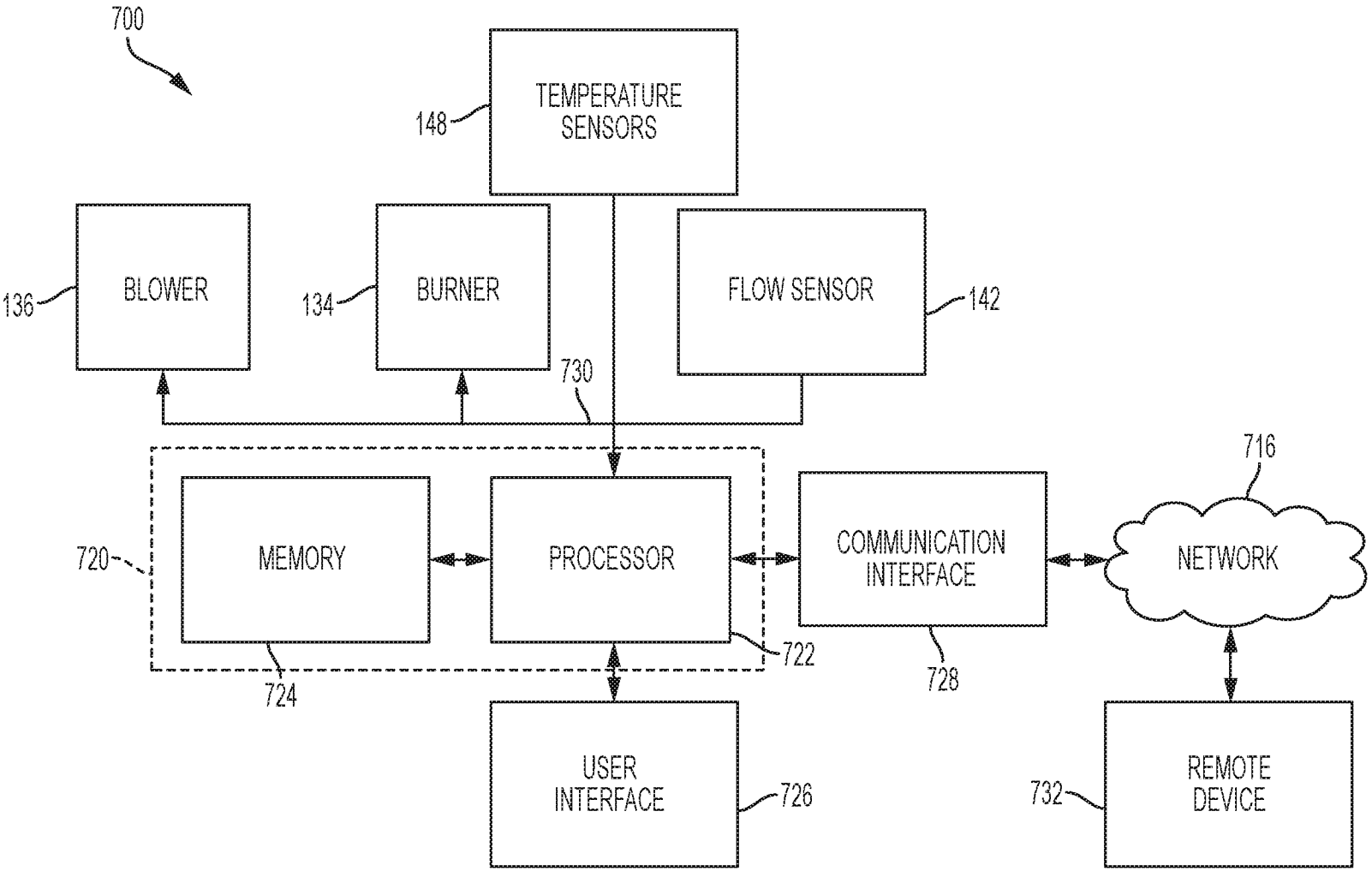
FIG. 7 illustrates a block diagram of one example of a control system for use with the heat exchanger as in FIG. 1 according to an embodiment.

Referring to FIGS. 1 and 7, the boiler may be controlled automatically from a remote device 732 that, under predetermined conditions, sends a signal to a controller 720 at the boiler, requesting that the boiler contribute heat to the coolant (e.g. water) and/or by user instructions entered through a user interface 726 disposed at the boiler. Remote device 732 may be, for example, a thermostat that sends signals to the boiler in response to conditions ambient to the thermostat, a device controlled by a system to which the boiler outputs the heated coolant, a user-controlled device (e.g. a mobile device that wirelessly communicate with controller 720), or a combination of such devices. In any of these instances, the signal from the remote device may include data corresponding to a target temperature at which the boiler is to provide the heated coolant. If, when controller 720 receives the remote device signal, the boiler is inactive, the controller first confirms that all of one or more predetermined safety-related conditions exist and, if so, ignites the burner and controls blower 136 to a predetermined speed that is less than the blower's maximum speed, thereby drawing fuel gas to the burner at a rate less than the maximum rate and setting the burner at a predetermined firing rate that is less than the burner's maximum general firing rate. The boiler controller may also control a system pump that moves the coolant through the boiler. Alternatively, in systems in which a separate control system operates the system pump, the controller confirms the system pump's operation before activating the burner and while the burner is in operation. Upon detecting the signal from a flame sensor proximate the burner that the burner has ignited, the boiler controller monitors the temperature sensor signal and compares the coolant temperature to the target temperature provided by remote device 732. If the actual coolant temperature from the temperature sensor signal is below the target temperature, the boiler controller controls the blower to operate at a speed that corresponds to a maximum operational firing rate of the burner, and continues to monitor the signal output by the temperature sensor. When the boiler controller, in a P-I-D configuration, detects that the actual coolant temperature at the boiler's output has then risen to a predetermined increment below the target temperature, the controller reduces the blower's speed an increment below that maximum operational speed, thereby reducing the burner's firing rate due to a corresponding reduction in flow of fuel gas to the burner, to reduce the amount of heat that the exhaust gas contributes to the coolant. When the temperature sensor signal indicates that the coolant temperature has reached the target temperature, the boiler controller deactivates the burner (via control of a valve in the fuel gas line to an off position and, after a period of time sufficient to purge combustion gases, deactivation of the blower). As long as remote device 732 continues to require heated coolant, the boiler controller continues to maintain the coolant pump in an activated state and continues to monitor the coolant temperature. If coolant temperature drops below a predetermined value (which is offset a predetermined amount below the target temperature, to prevent over-cycling), the controller reactivates the burner (at the predetermined initial ignition firing rate as discussed herein), and the cycle proceeds as described above. If, during the boiler's operation, boiler controller 720 receives a signal from remote device 732 indicating the need for heated coolant has ended, the boiler controller deactivates the burner and the system/coolant pump (if the controller controls the system pump) and awaits the next heat request signal from the remote device.

Example Burner Firing Rate Control

As described above, controller 720, following the burner's initial ignition, controls the burner's firing rate so that the coolant output from the burner achieves the target temperature provided by remote device 732. When comparison of the actual coolant output temperature to the target temperature results in the need to contribute heat to the coolant, the controller controls the burner's firing rate to a maximum operational firing rate or to another firing rate determined, for example, by a P-I-D controller configuration at controller 720, thereby moving the coolant toward the target temperature. Regardless of the algorithm by which the controller establishes the burner firing rate to move coolant temperature toward the target, the maximum operation firing rate is a cap on that firing rate. Thus, for example, if the controller algorithm defines a 60% firing rate when the maximum operation firing rate is 80%, the controller drives the burner to a 60% firing rate. If, however, the controller would, in absence of the maximum operational firing rate, drive the burner to a 90% firing rate when the maximum operational firing rate is 80%, the controller drives the burner to an 80% firing rate. In one or more embodiments as described herein, controller 720 controls the boiler's operation as described above but varies the value of the maximum operational firing rate based on a predetermined relationship between coolant flow rate and a differential temperature of coolant between predetermined positions in the coolant flow path across the boiler.

The predetermined relationship results in a boiler operation that reduces effects of heat exchanger heat stress. As described above, the boiler's operation at undesirable conditions can cause system degradation. One such condition, for example, can occur when the burner operates at a high firing rate while the coolant flow rate is relatively low. Such condition results in a high "DT" (the difference between the temperature of coolant at predetermined first and second positions in the coolant's flow path through the heat exchanger), for example the difference between temperature of coolant entering the heat exchanger and temperature of coolant exiting the heat exchanger. Since the rate at which coolant can accept heat decreases as the coolant's temperature increases, the increased DT can correspond to increased heat retained in the heat exchanger components as the coolant becomes less able to draw heat from those components at lower flow rates, resulting in stress to system components.

To reduce heat stress over the boiler's operation in one or more of the embodiments described herein, the boiler controller varies the burner's maximum operational firing rate with coolant flow rate following initial ignition, and more specifically varies the maximum operational firing rate in the same direction as coolant flow rate when flow rate varies. Thus, as controller 720 operates the burner and the boiler according to the algorithm described above, the controller adjusts the maximum operational firing rate within that algorithm in response to coolant flow rate dynamically as the flow sensor measures and reports coolant flow rate to the controller, and in some embodiments also in response to coolant specific heat, to thereby maintain burner firing rate and heat input below levels likely to cause damaging stress within boiler components.

As described in more detail below, the burner's firing rate is related to DT, so that a relationship between coolant flow rate and DT can be used to define a relationship between coolant flow rate and the burner's maximum operational firing rate following the burner's initial ignition. In one or more embodiments, the relationship between DT and coolant flow includes two points from which the remainder of the relationship is defined: a maximum desired DT at the coolant's maximum flow rate and a DT at the burner's ignition. The boiler's manufacturer defines the boiler's maximum DT during the boiler's normal operation (hereinafter, "DT@maxRate," described in these examples in ° F.) based on system testing and analysis of the boiler's construction and engineering specifications of its components. In certain embodiments, DT@maxRate may be defined or redefined after manufacture by a user configuring the system's operation, but for purposes of example, this parameter is discussed herein as manufacturer-defined. The manufacturer may define DT@maxRate through testing of the boiler while coolant is flowing through the heat exchanger at its maximum expected rate, varying the burner's firing rate while measuring DT and system component stresses, and determining a DT level that is below a level at which stresses begin to occur to an undesirable degree.

The manufacturer or user may also define the boiler's maximum heat input, which corresponds to the energy (e.g. in British Thermal Units/hour, or BTUH) that burner 134 (FIG. 1) contributes to the heat exchanger when the burner operates at the greatest firing rate at which the controller programming can operate the burner. Maximum heat input is a boiler design requirement. That is, a decision is made, prior to designing the boiler, what maximum heat input will be required, and the burner, blower, heat exchanger components, and other boiler components are selected so that the boiler would operate at that maximum heat input level under ideal conditions, where maximum heat input is the heat input that the system is capable of contributing when the burner operates at its maximum firing rate. It will be understood that while the maximum heat input is an ideal parameter, the actual maximum heat input will be somewhat lower than ideal, in view of system efficiency. Accordingly, the equations below incorporate an efficiency factor. Efficiency depends on the system's construction, but in certain embodiments an assumption of 95% or approximately 95% is appropriate. As described below, for a given system efficiency at which the boiler operates, and for a given coolant type, there is an identifiable coolant flow rate (referenced below as "MinFlow@maxRate") that results in the maximum permissible operational DT (DT@maxRate) when the burner operates at its maximum heat input.

The coolant's flow rate through the heat exchanger, however, can vary during the boiler's operation. If coolant flow rate increases while the heat exchanger burner is operating at its maximum operational firing rate, which corresponds to the burner's maximum heat input to the system, DT will decrease. That is, an increase in coolant flow rate from MinFlow@maxRate generally does not increase the risk of stress to system components. If, on the other hand, coolant flow decreases while the burner is operating at its maximum operational firing rate, DT will increase. That is, if the burner maintains operation at the maximum heat input rate, fluctuations in the coolant flow rate below MinFlow@maxRate can impart stresses to burner components as DT correspondingly increases over the manufacturer-specified maximum DT. Thus, MinFlow@maxRate may be considered the minimum desired coolant flow rate when the burner is operating at the highest firing rate over the range of maximum operational firing rates as described herein, or the minimum desired coolant flow rate at DT@maxRate.

The boiler's controller (FIG. 7) operates as defined by computer program instructions that the controller executes. In one or more embodiments described herein, the controller monitors actual coolant flow rate through the heat exchanger, as indicated by signals the controller receives from flow sensor 142 (FIGS. 1 and 7). Responsively, the program instructions cause the controller to determine a maximum desired DT for the detected flow rate according to a predetermined correlation between DT and flow rate, as described below. Having the target DT from this predetermined relationship, the controller determines the burner's maximum operational firing rate according to a predetermined relationship between DT and burner firing rate, also discussed below. As a result, the boiler should operate at or below the target DT at the detected flow rate.

The control of the burner's firing rate based on the predetermined relationship between DT and coolant flow rate inhibits DT from rising high enough, in view of coolant flow rate conditions, to encourage the rise of undesirable heat stress levels in boiler components. In certain embodiments, the instructions cause the controller to determine the desired burner firing rate dynamically as the controller acquires actual flow rate data, and then control the burner to that desired firing rate. In other embodiments, the controller defines a range of firing rates that could correspond to the available DT values as defined by the predetermined relationship as part of system calibration and stores the data in memory encompassed by or accessible to the controller. The data associates firing rates (over the range of possible firing rates) with corresponding coolant flow rates. In such latter embodiments, in operation of the boiler after ignition, the controller detects coolant flow rate, accesses the memory to determine the desired firing rate corresponding to the detected flow rate, and controls the burner according to the controller's normal heat control algorithm (in which the controller controls the burner firing rate in response to comparison of the output coolant temperature to the target temperature from remote device 732) while relying on the selected firing rate as the burner's maximum operational firing rate within that algorithm.

Regardless of the manner in which the controller manages the relationship data, the controller, as it repeatedly checks the flow sensor output, correspondingly adjusts the maximum burner operational firing rate to impose a boundary on DT based upon the predetermined relationship between DT and coolant flow rate. If flow rate increases, the controller increases the burner's maximum operational firing rate (if the maximum operational firing rate is not already at DT@maxRate), while if flow rate decreases, the controller decreases the burner's maximum operational firing rate (if the maximum operational firing rate is not already at a predetermined minimum rate). More specifically, for a given detected flow rate, the controller determines the desired maximum operational firing rate by (a) determining a desired DT based on the predetermined correlation between DT and flow rate, (b) determining a target input rate for the selected DT from the hydronic thermal equation, considering applicable system parameters, and (c) converting input rate to burner firing rate. The determinations of the DT/flow rate relationship and the resulting firing rate are described in more detail below.

The DT/coolant flow rate relationship is based on heat input rate and the boiler's efficiency, which the manufacturer determines through system design and testing and provides as part of the boiler's operating parameters but which, as should be understood, could be determined by the user through testing. As indicated above, system efficiency relates heat input and coolant flow rate. Generally, the efficiency of the heat exchanger may be expressed by the hydronic thermal equation:

$$Eff \cong \frac{500 * (\text{Flow}) * DT}{\text{Input Rate}}; \quad \text{Eqn. 1}$$

For Water @ *STP* (Standard Temperature & Pressure).

If the coolant is other than water, which has a specific heat ($C_p$) of 1, the equation becomes:

$$Eff \cong \frac{500 * (\text{Flow}) * Cp * DT}{\text{Input Rate}}.$$

As discussed above, DT corresponds in this example to the differential temperature or coolant across the heat exchanger (in this example, in degrees Fahrenheit). "Input Rate" refers to the heat input rate of heat exchanger 100, and particularly burner 134 (in this example, in BTUH). "Flow" refers to the coolant's flow rate through heat exchanger 100 (in this example, in gallons per minute, or "gpm." The number 500 is a constant that defines the equation for standard temperature and pressure. It will be understood that temperature and pressure will vary during the boiler's use. Such variation can affect the value of the constant. In certain embodiments as described herein, the constant value of 500 is used for all calculations described herein, as it has been found that pressure and temperature variations do not result in significant variations in the constant, so that 500 is a suitable approximation for the boiler's operation. In other embodiments, however, the controller monitors coolant temperature and pressure and dynamically modifies the constant in determining maximum operational firing rate.

Based on the hydronic thermal equation, the controller may control the maximum operational firing rate of burner 134 in response to detected coolant flow rate to thereby maintain DT within a target value defined by a linear relationship between DT and coolant flow rate through heat exchanger 100 that extends between two known points in the boiler's operation. The first point occurs at DT@maxRate and MinFlow@maxRate. MinFlow@maxRate may be calculated based on DT@maxRate, the boiler's input rate at DT@maxRate, and the efficiency of heat exchanger 100, as $$MinFlow@maxRate[\text{gpm}] = \text{Input}\left[\frac{\text{BTU}}{\text{hr}}\right] * Eff \Big/ 8.3207\left[\frac{\text{lb}}{\text{g}}\right] * 60\left[\frac{\text{min}}{\text{h}}\right] * 1\left[\frac{\text{BTU}}{\text{lb}\ ^\circ\text{F.}}\right] * DT@maxRate[^\circ\text{ F.}]. \quad \text{Eqn. 2}$$

In this equation, "Input" is the boiler's maximum heat input (100% of the boiler's maximum heat input rate as discussed above under ideal conditions), and is multiplied by efficiency of the boiler. "Eff" is the boiler's rated efficiency, as described above. The constant has been separated into components that illustrate units. The coolant is water, such that $C_p$=1. DT@maxRate is described above.

The second boiler operational point occurs at the boiler's initial ignition. The manufacturer specifies the minimum rate at which coolant should flow through the boiler as the boiler is ignited (hereinafter "MinFlow@Ignition"). This coolant flow rate, which the boiler manufacturer determines through testing, is the minimum coolant flow rate needed to absorb heat generated by the burner at ignition so that damage to the heat exchanger is avoided.

The boiler controller (FIG. 7) can determine whether the boiler's burner is not ignited based on a signal from a flame detector at the burner surface. If, when the burner is not ignited, the controller receives a heat demand signal from a thermostat or other remote device 732 (FIG. 7) or interface 726 (FIG. 7), thereby constituting a request that the controller actuate the burner, the controller's programming prevents the controller from actuating the burner if the coolant flow rate indicated by the signal the controller receives from flow sensor 142 (FIG. 1) is below MinFlow@Ignition. Also known, or determinable through testing, is the ignition rate, which is the percentage of the boiler's highest heat input rate (over the boiler's operation as controlled by the controller) that burner 134 contributes at ignition. The burner's input rate at ignition (hereinafter "Input@Ignition"), therefore, is equal to the burner's maximum input rate multiplied by the ignition rate. DT at ignition (hereinafter "DT@ignition") may be calculated, again based on the hydronic thermal equation, as:

$$DT@\text{Ignition}[^\circ\text{ F.}] = \text{Input@Ignition}\left[\frac{\text{BTU}}{hr}\right] * Eff \Big/ 8.3207\left[\frac{\text{lb}}{\text{g}}\right] * 60\left[\frac{\text{min}}{\text{h}}\right] * 1\left[\frac{\text{BTU}}{\text{lb}\ ^\circ\text{F.}}\right] * MinFlow@\text{Ignition}[gpm]. \quad \text{Eqn. 3}$$

As indicated above, Efficiency, DT@maxRate, MinFlow@Ignition, Input@Ignition, the burner's highest operational heat input rate (or highest operational firing rate), and the burner minimum firing rate (discussed below) are predetermined boiler parameters. The manufacturer determines these parameters through analysis of boiler components and architecture and through testing, e.g. as governed by industry standards such as ANSI Z21.13 (section 5.6) and industry certification, as should be understood.

Figure 3:
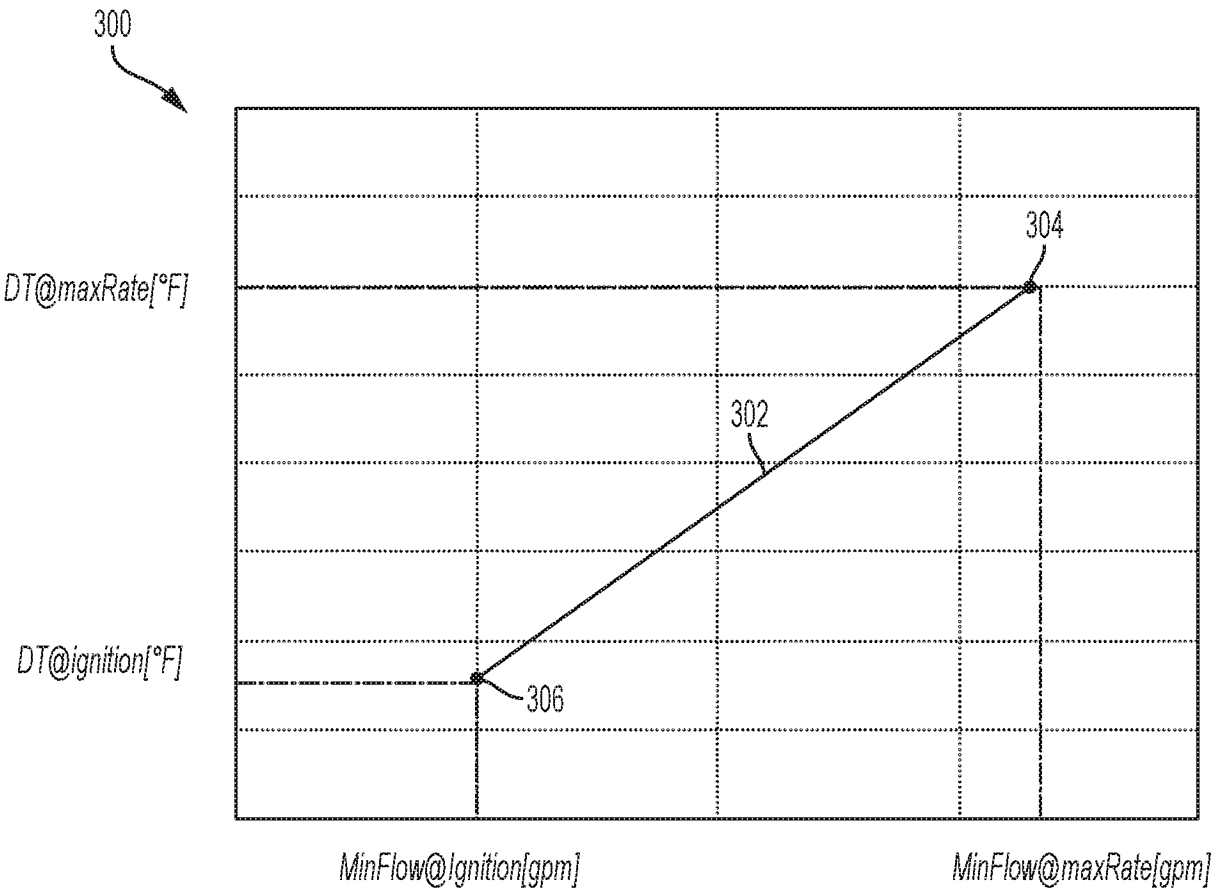
FIG. 3 illustrates a graph of differential temperature across the heat exchanger as a function of flow according to an example embodiment.

FIG. 3 illustrates a graph 300 of the DT as a function of flow rate based on the minimum flow at maximum firing rate and a DT at ignition rate, as calculated above. A linear slope 302 may be defined in DT/coolant flow rate space that includes the two points (a) DT@maxRate at MinFlow@maxRate 304 and (b) DT@Ignition at MinFlow @Ignition 306. Using a line equation (y=mx+b), the slope 302 of DT may be described as:

$$DT[^\circ\text{ F.}] = \left(\frac{DT@maxRate[^\circ\text{ F.}] - DT@\text{Ignition}[^\circ\text{ F.}]}{MinFlow@maxRate[\text{gpm}] - MinFlow@\text{Ignition}[\text{gpm}]}\right) * (\text{Flow}[\text{gpm}] - MinFlow@\text{Ignition}[\text{gpm}]) + DT@\text{Ignition}[^\circ\text{ F.}] \quad \text{Eqn. 4}$$

Slope 302, defined by these two points (304 and 306), represents a relationship between coolant flow rate and heat contribution to the boiler components that reduces the amount of heat that the boiler's heat exchanger components retain, and therefore reduces the amount of heat stress, over the boiler's use, as compared to prior systems in which the boiler always drives the burner based on a constant maximum operational firing rate (corresponding to the burner's overall maximum firing rate) after initial ignition, without consideration of coolant flow. While it has been found that the boiler's operation at the linear relationship 302 results in longer boiler component life due to reduced heat stress, it is also encompassed by the present disclosure to select other balances between coolant flow rate and DT. As will be apparent from the present disclosure, for example, the boiler's operation at relationship 302 can result in periods of time for the coolant to reach its target temperature from the boiler's initial ignition that are longer than would occur when the boiler is operated to maximize burner firing rate after ignition without consideration of coolant flow. Accordingly, line 302 can be modified from the slope described by FIG. 3 by changing the point defined by DT @Ignition/MinFlow @Ignition 306 so that the DT value for this point 306 is increased and using the new DT value in place of DT@Ignition in Equation 4. This reduces the slope of line 302 and causes the boiler to drive more aggressively toward the target coolant output temperature. As discussed in more detail below, the manufacturer or operator may enter a value for DT through the user interface to override the calculated value DT @Ignition to thereby control the line 302 slope. In certain embodiments, the programming executed by processor 720 (FIG. 7) is configured to present, at a user interface at the remote device 732 and/or interface 726 (FIG. 7), an option by which the manufacturer or user can select a DT value for the point defined by DT@Ignition/MinFlow @Ignition 306, ranging from DT=DT @Ignition based on Equation 3 to DT=DT@MaxRate. Upon receiving the selected DT, the controller uses the selected DT for DT@Ignition in Equation 4 instead of DT@Ignition from Equation 3. In such embodiments, the controller controls the firing rate at initial ignition to be the firing rate defined by line 302 in FIG. 3 (based on Equation 3), given the actual flow rate as detected by the flow sensor. Once the controller determines, based on the flow sensor output, that the burner has ignited, the controller controls the burner firing rate based on the line determined by the user-selected DT.

The controller (FIG. 7) may determine the burner heat input rate needed to drive the boiler to a DT defined by the linear relationship between DT and coolant flow rate, in response to a signal from flow sensor 142 indicating actual flow, based on the hydronic thermal equation. In some example embodiments, the hydronic thermal equation may be expanded to include not only the specific heat ($C_p$) of the coolant but also an additional protection factor (Prt), as described below.

$$InputRate[\text{BTUh}] = \frac{8.3207\left[\frac{\text{lb}}{\text{g}}\right] * 60\left[\frac{\text{min}}{\text{hr}}\right] * Cp\left[\frac{\text{BTU}}{\text{lb}\ ^\circ F.}\right] * DT[^\circ\text{ F.}] * \text{FLOW}[\text{gpw}]}{Eff} * Prt \quad \text{Eqn. 5}$$

Since the boiler's highest heat input rate, which occurs at the burner's highest firing rate, is known, the percentage ((input rate from Eqn. 5)/highest input rate)*100 is the percentage of the burner's highest firing rate at which the burner should be operated to drive the boiler at the target DT defined by the relationship with flow rate. In this example, then, this is the boiler's and the burner's maximum operational firing rate for this given coolant flow rate.

Accordingly, the controller may use the DT calculated in Equation 4 in determining, at Equation 5, burner heat input rate and, thus, the burner's maximum operational firing rate for a given detected flow rate. The program instructions, in turn, cause the controller to automatically and dynamically adjust the maximum operational firing rate as a function of the detected flow rate according to the predetermined linear relationship between DT and coolant flow rate. In executing this process, the computer program relies on certain of the following nine parameters, each discussed above or below, that are specific to the boiler and its design and that may be provided to the controller and the program via the user interface during set up of the controller system and the boiler's calibration, e.g. through manual data entry or electronic data transfer:

Boiler maximum heat input rate;
Coolant $C_p$ (default=1 if user does not enter value),
Boiler efficiency (Eff);
DT@maxRate;
MinFlow@Ignition;
Ignition input rate;
DTmax;
DT offset; and
Prt (default=1 if user does not enter value).

At calibration, following entry of these parameters, the program instructions cause the controller to calculate MinFlow@maxRate and DT@Ignition, as discussed above, which (in combination with DT@maxRate and MinFlow@Ignition, respectively) define line 302. As noted, DT@Igntion is the default for the lower-flow point in the definition of line 302, but the program may also allow the user to enter (via the user interface) a DT value ("DTOverride") to override DT@Ignition in the line's definition. Where the user enters a value for DTOverride, then DTOverride replaces DT@Ignition in the equations herein, else the program utilizes the calculated value of DT@Ignition.

The controller stores these two parameter values (MinFlow@maxRate and DT@Ignition/DTOverride), along with the nine user-entered parameter values, in the controller's stored memory or in memory to which the controller otherwise has access. Thereafter, following the burner's ignition, the controller detects flow rate from the flow rate sensor signal and, in response to each flow rate detection, executes equations 4 and 5 to determine a corresponding firing rate. Alternatively, at calibration and in response to the operator's entry of the above-described user entry parameters and to the controller's determination of MinFlow@maxRate and DT@Ignition therefrom, the controller determines the firing rate from Equations 4 and 5 for each of a plurality of incremental flow rate values between MinFlow@Ignition and MinFlow@maxRate and stores the corresponding pairs of flow rates and firing rates (which correspond to line 302) in memory in or otherwise accessible to the controller. The increment between flow rate values can be determined by the manufacturer/user and entered as a setup variable through the user interface. When, during the boiler's later use, the controller receives a signal from the flow sensor indicating an actual flow rate, the controller finds the stored flow rate closest to the actual flow rate and selects the firing rate associated with that flow rate. Upon determining a maximum operational firing rate, whether by real-time execution of Equations 4 and 5 or by lookup table, the controller then controls the burner's operation in bringing the coolant output temperature to the target temperature supplied by remote device 732, using this maximum operational firing rate as an upper bound on the burner's firing rate within that algorithm.

In an example embodiment, and as illustrated in the equations above, the coolant's specific heat impacts the maximum operational firing rate determined by the linear relationship represented by line 302. Table A provides the specific heat of the coolant for a water/propylene glycol solution. Table B shows the specific heat of the coolant for a water/ethylene glycol solution.

TABLE A

| Specific Heat [Btu/lb ° F.] vs. Propylene Glycol % @ 40° F. | | | | |
|---|---|---|---|---|
| 0% | 20% | 30% | 40% | 50% |
| 1.004 | 0.941 | 0.909 | 0.872 | 0.83 |

TABLE B

| Specific Heat [Btu/lb° F.] vs. Ethylene Glycol % @ 40° F. | | | | |
|---|---|---|---|---|
| 0% | 25% | 30% | 40% | 50% |
| 1.004 | 0.913 | 0.89 | 0.845 | 0.795 |

Using the specific heat values for the various glycol concentrations of the coolant in Equation 5 results (assuming Prt=1) in the maximum operational firing rate being a function of three variables (flow rate, DT, and $C_p$) all in one governing equation.

Table C illustrates an example calculation of DT for a heat exchanger having a highest input rate of 1,000,000 BTUH, an ignition input rate of 40 percent when 100% water is used as the coolant (this is a percentage applied to the maximum input rate to thereby define the heat input rate at the burner's initial ignition and also indicates the percent of the burner's maximum firing rate that occurs at initial ignition), a minimum input/firing rate of eight percent, an efficiency of 95 percent, a DT@MaxRate of sixty degrees Fahrenheit, a MinFlow@Ignition of twenty gpm, and a Prt of 1.0. Applying Equation 2, MinFlow@maxRate is 31.7 gpm. Applying Equation 3, DT@Ignition is 38.1 degrees Fahrenheit. The first two columns of Table C provide incremental flow rate values and corresponding DT values for a linear relationship (as in line 302 of FIG. 3) defined by the application of Equation 4 to these parameters. The firing rates to achieve each DT defined by the linear relationship are calculated for different concentrations of ethylene glycol, as reflected by columns three through seven, which provide rates (in terms of percentage applicable to the boiler/burner maximum firing rate) that define the burner's firing rate at each flow rate/DT point in the linear relationship and for each coolant example, ranging from 100% water (0% ethylene glycol, with a $C_p$ of 1) to a 50% water/glycol mixture (with a $C_p$ of 0.795). Thus, at flow rate=20 gpm (i.e. MinFlow@Ignition) and DT=38.1 (i.e. DT@Ignition), the input rate for coolant=100% water is 40%*1,000,000 BTUH=400,000 BTUH, and the burner's maximum operational firing rate is 40%, as indicated on that row at column three. The values in column three may be determined via Equation 5, by dividing the calculated InputRate[BTUh] by the boiler's highest input rate. For the row for 20 gpm, for example, InputRate=(8.3207*60*1*38.058*20)/0.95=approximately 400,000 BTUH. Thus, Mod %=400,000/1,000,000=40%. The $C_p$ used in Equation 5 is from Table B, 1. The Mod % for the same row, for columns four through seven, can also be determined from Equation 5, substituting the applicable $C_p$ as provided in Table B. Columns four through seven thus provide the increasingly-lower percentage rates applicable to the maximum firing rate (for this row at column seven, the firing rate is 31.8% of maximum) for each coolant having increasingly-higher glycol percentages. Columns four through seven may also be determined by applying the $C_p$ values of columns two through four, respectively, to the firing rate percentage of row 20, column three.

For this example boiler, given the parameter values discussed herein, Equation 5 for the MOD % can be reduced to the following equation: MOD $\%=(-0.0014*C_p+0.0955)*FLOW^2+(0.027*C_p+0.0891)*FLOW$, where FLOW is the flow rate in Table C, column one, and $C_p$ is the specific heat for the coolant being used, as for instance provided in Tables A or B (again, Prt in this example is 1).

Thus, once the DT/flow rate relationship (Table C, columns one and two) is determined at the boiler's calibration via Equation 4, the controller may complete the remaining columns of Table C for each known coolant option for the boiler and for each ingredient concentration option for that coolant using Equations 4 and 5, creating a Table C for each coolant. Assuming, during calibration, that the boiler is set up for multiple of various coolants and ingredient concentrations, resulting in a plurality of Tables C stored in memory 724 (FIG. 7), then as the boiler is operated, a user may select the coolant and ingredient concentration via a selectable listing of available coolants and ingredient concentrations via user interface 726 (FIG. 7). The processor receives this selection. As the processor then receives flow data from sensor 142 (FIGS. 1 and 7), the processor selects the Table C corresponding to the user's coolant selection, determines the row for the received flow rate, and selects the MOD % for the Table C column corresponding to the user's ingredient concentration selection, thereby identifying the MOD % to apply as the maximum operational firing rate at which the control system controls burner 134 (FIGS. 1 and 7).

As illustrated in Table C, the increased use of glycol in the coolant corresponds to decreased energy consumption at the burner to achieve the DT defined by the linear relationship at each flow rate. When the coolant is 100% water, MinFlow@maxRate=31.7 gpm, as indicated by the 100% values in column three for flow rate 32. That is, when the coolant is 100% water, the system reaches DT@maxRate at a 31.7 gpm flow rate, and regardless of detection of higher flow rates, the boiler controller will maintain the burner firing rate at its maximum operational level. Conversely, if the controller detects an actual flow rate from the flow sensor output signal that is sufficiently low that the linear relationship results in a burner firing rate below the burner's rated minimum firing rate, the controller deactivates the burner, as indicated by the zero values at Table C. It will be noted that, as indicated at Table C for this embodiment, while the controller will initially ignite the burner only where the coolant flow rate is at least twenty gpm, coolant flow rate may, after ignition, fall below the twenty gpm level during the boiler's normal operation.

TABLE C

| | | MOD % | | | | |
|---|---|---|---|---|---|---|
| GPM | DT ° F. DT | 0% Glycol | 25% Glycol | 30% Glycol | 40% Glycol | 50% Glycol |
| 0 | 0.597 | 0.00 | 0.00 | 0.00 | 0.00 | 0.00 |
| 1 | 2.470 | 0.00 | 0.00 | 0.00 | 0.00 | 0.00 |
| 2 | 4.343 | 0.00 | 0.00 | 0.00 | 0.00 | 0.00 |
| 3 | 6.216 | 0.00 | 0.00 | 0.00 | 0.00 | 0.00 |
| 4 | 8.089 | 0.00 | 0.00 | 0.00 | 0.00 | 0.00 |
| 5 | 9.962 | 0.00 | 0.00 | 0.00 | 0.00 | 0.00 |
| 6 | 11.835 | 0.00 | 0.00 | 0.00 | 0.00 | 0.00 |
| 7 | 13.708 | 0.00 | 0.00 | 0.00 | 0.00 | 0.00 |
| 8 | 15.581 | 0.00 | 0.00 | 0.00 | 0.00 | 0.00 |
| 9 | 17.454 | 8.26 | 0.00 | 0.00 | 0.00 | 0.00 |
| 10 | 19.327 | 10.16 | 9.27 | 9.04 | 8.58 | 8.07 |
| 11 | 21.200 | 12.26 | 11.19 | 10.91 | 10.36 | 9.74 |
| 12 | 23.073 | 14.55 | 13.28 | 12.95 | 12.30 | 11.57 |
| 13 | 24.946 | 17.04 | 15.56 | 15.17 | 14.40 | 13.55 |
| 14 | 26.819 | 19.73 | 18.02 | 17.56 | 16.67 | 15.69 |
| 15 | 28.692 | 22.62 | 20.65 | 20.13 | 19.11 | 17.98 |
| 16 | 30.565 | 25.70 | 23.46 | 22.87 | 21.72 | 20.43 |
| 17 | 32.439 | 28.98 | 26.46 | 25.79 | 24.49 | 23.04 |
| 18 | 34.312 | 32.46 | 29.63 | 28.89 | 27.43 | 25.80 |
| 19 | 36.185 | 36.13 | 32.99 | 32.16 | 30.53 | 28.72 |
| 20 | 38.058 | 40.00 | 36.52 | 35.60 | 33.80 | 31.80 |
| 21 | 39.931 | 44.07 | 40.23 | 39.22 | 37.24 | 35.03 |
| 22 | 41.804 | 48.33 | 44.13 | 43.01 | 40.84 | 38.42 |
| 23 | 43.677 | 52.79 | 48.20 | 46.98 | 44.61 | 41.97 |
| 24 | 45.550 | 57.45 | 52.45 | 51.13 | 48.54 | 45.67 |
| 25 | 47.423 | 62.30 | 56.88 | 55.45 | 52.65 | 49.53 |
| 26 | 49.296 | 67.36 | 61.50 | 59.95 | 56.92 | 53.55 |
| 27 | 51.169 | 72.60 | 66.29 | 64.62 | 61.35 | 57.72 |
| 28 | 53.042 | 78.05 | 71.26 | 69.46 | 65.95 | 62.05 |
| 29 | 54.915 | 83.69 | 76.41 | 74.48 | 70.72 | 66.53 |
| 30 | 56.788 | 89.53 | 81.74 | 79.68 | 75.65 | 71.18 |
| 31 | 58.661 | 95.57 | 87.25 | 85.05 | 80.75 | 75.97 |
| 32 | 60.534 | 100.00 | 91.30 | 89.00 | 84.50 | 79.50 |

As indicated in the discussion above, the MOD % represents a maximum burner operational firing rate at a given flow rate. In determining how to control the burner in response to comparison of the target coolant temperature from a remote device 732 (FIG. 7), or entered via interface 726 (FIG. 7), to the actual coolant temperature from the boiler output coolant temperature sensor, the boiler controller first compares the target coolant temperature to the actual coolant temperature. If actual coolant temperature is below target coolant temperature, the controller needs to operate the burner to contribute heat to the coolant to therefore move coolant temperature toward the target. Thus, the controller determines a burner firing rate according to the controller's general algorithm, e.g. effecting a P-I-D controller arrangement, at which the controller would operate the burner for this purpose. Before so controlling the burner, however, the controller compares this burner firing rate to the maximum operational firing rate based on the DT/coolant flow rate relationship as described above. If the desired burner firing rate is below the maximum operational firing rate, the controller proceeds to operate the burner at the desired burner firing rate. If, however, the desired burner firing rate is above the maximum operational firing rate, the controller operates the what the maximum operational firing rate. The controller repeats this process each time the controller checks the comparison between the target coolant temperature and the actual output coolant temperature, at an interval determined by the controller program's general algorithm.

Figure 4:
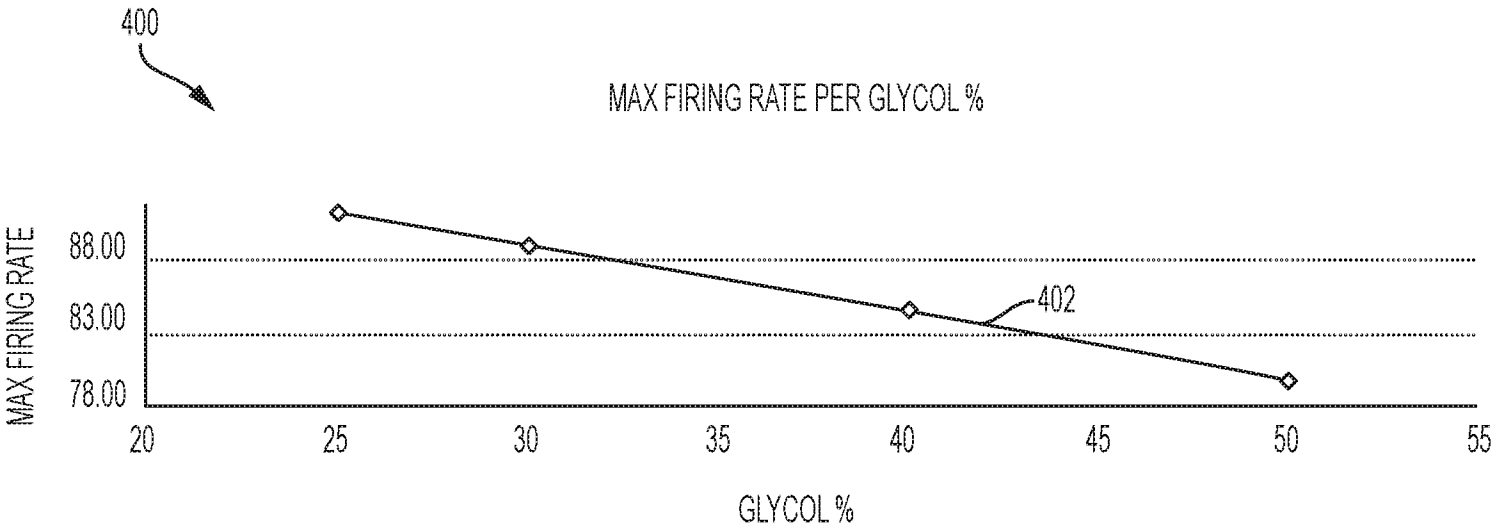
FIG. 4 illustrates a graph of maximum firing rate for given ethylene glycol concentrations according to an example embodiment.

As depicted in Table C and in graph 400 of FIG. 4, the maximum operational firing rate may decrease as the concentration of (in this example, ethylene) glycol increases. Line 402 of graph 400 starts at a maximum firing rate of 91.3 at 25 percent glycol and decreases linearly to 79.5 at 50 percent glycol.

Figure 5:
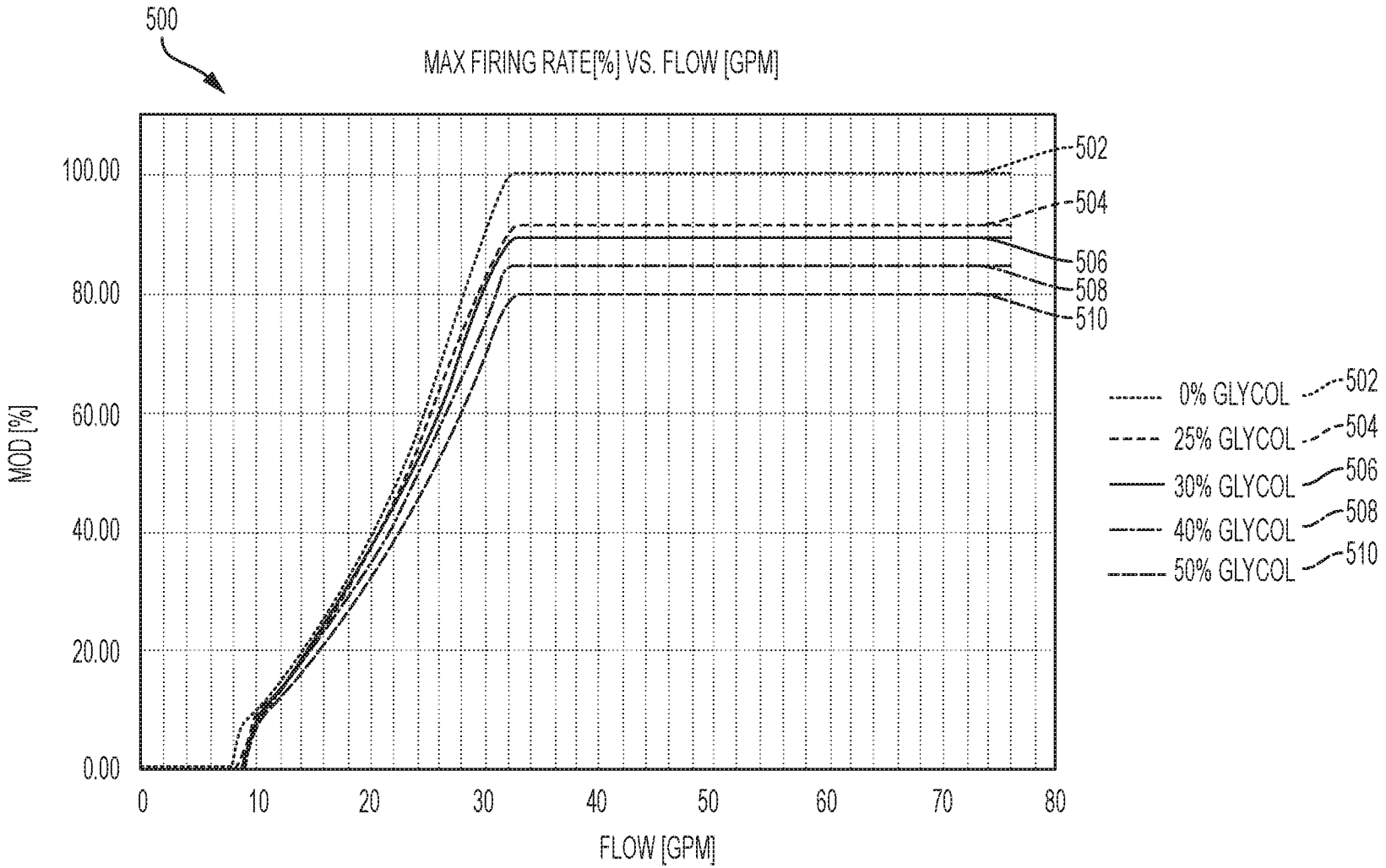
FIG. 5 illustrates maximum firing rate for given flow rates according to an example embodiment.

FIG. 5 illustrates a graph 500 of maximum operational firing rates as a function of coolant flow rate for different concentrations of ethylene glycol in the coolant solution, correlated to the firing rate values of Table C. Line 502 corresponds to zero percent glycol; line 504 corresponds to 25 percent glycol; line 506 corresponds to thirty percent glycol; line 508 corresponds to forty percent glycol, and line 510 corresponds to fifty percent glycol. The controller's programming presents the operator, via the user interface at 726 or at a remote device 732, with discrete choices for coolant/glycol concentration, in this example zero %, 25%, 30%, 40%, and 50%. Before operating the boiler, the operator installs the water/glycol coolant with one of these glycol concentrations and selects, via the user interface, the applicable glycol percentage from the presented list. The controller then utilizes the $C_p$ value associated in memory with the selected glycol level in in the equations described herein to define burner firing rate corresponding to coolant flow rate. As shown, in graph 500 and based on Eqn. 2, after initial ignition, the flow rate may be reduced below that of minflow@ignition; as a result, the firing rate may also be reduced.

Figure 9:
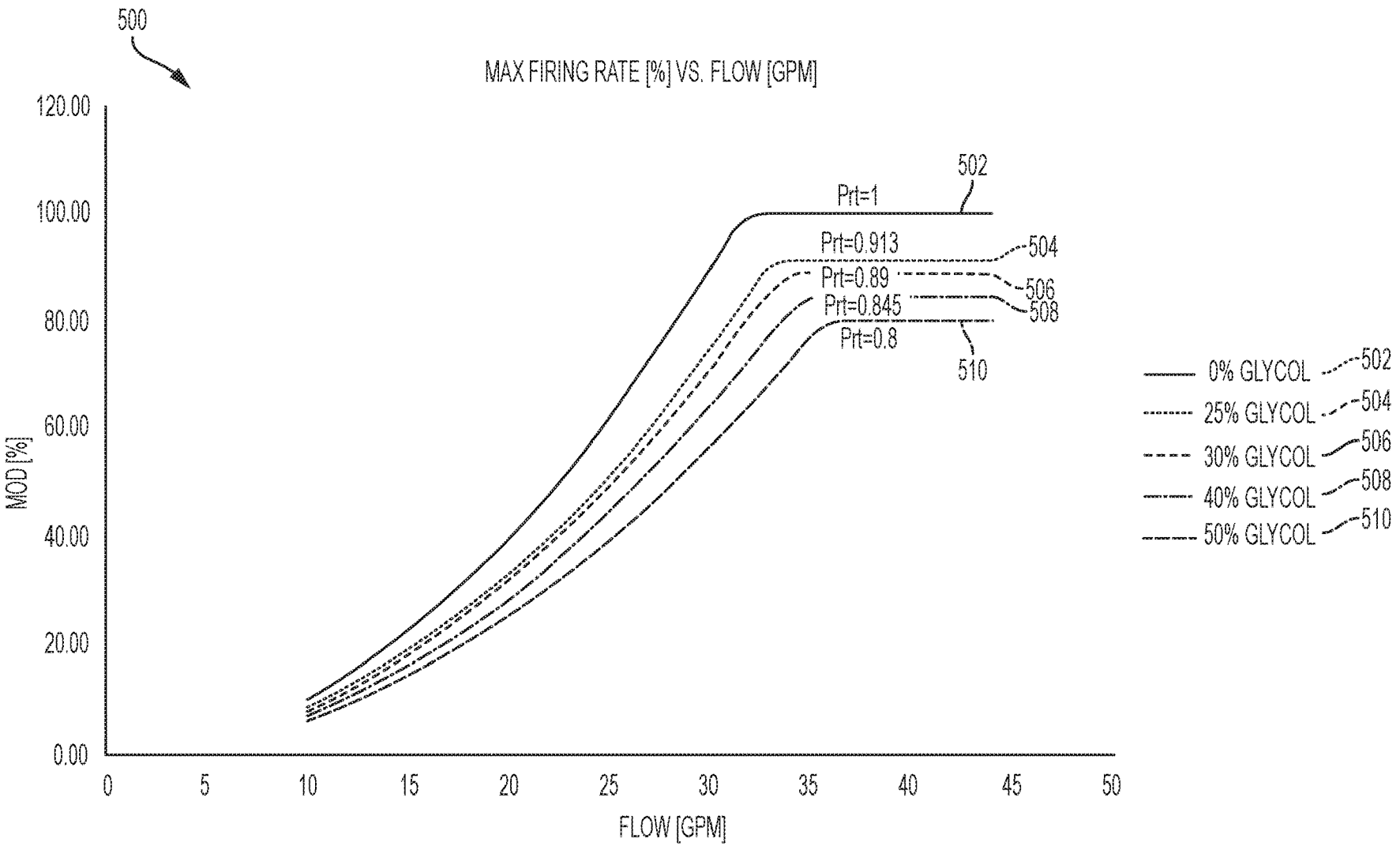
FIG. 9 illustrates maximum firing rate for given flow rates according to an example embodiment.

FIG. 9 illustrates a graph 500 of maximum operational firing rates as a function of coolant flow rate for different concentrations of ethylene glycol in the coolant solution, correlated to the firing rate values of Table C but with modifications in Prt in Equation 5 for coolants with respective glycol concentrations. Line 502 corresponds to zero percent glycol and Prt=1; line 504 corresponds to 25 percent glycol and Prt=0.913; line 506 corresponds to thirty percent glycol and Prt=0.89; line 508 corresponds to forty percent glycol and Prt=0.845, and line 510 corresponds to fifty percent glycol and Prt=0.8. Prt can be used to compensate for differences in actual flow rates among different field installations and overcome other variables, such as pressure drops, piping length, or other conditions that may affect how well the results of Equation 5 and its component calculations correlate the burner firing rate/coolant flow rate relationship to maintaining heat exchanger component heat stresses within desired levels. As can be seen in FIG. 5, differences in the boiler's operation based on coolants having different glycol levels are relatively small. In order to provide a larger spread in operational performance, thereby allowing the operator, by selecting a coolant having a given glycol concentration, to choose a firing rate/coolant flow rate relationship (or a DT/coolant flow rate relationship) that best maintains heat stresses within desired levels, Prt factors are selected and associated with respective coolant glycol concentrations in the controller memory. The controller's programming presents the operator, via the user interface at 726 or 732 (FIG. 7), with discrete choices for coolant/glycol concentration, in this example zero %, 25%, 30%, 40%, and 50%. Before operating the boiler, the operator installs the water/glycol coolant with one of these glycol concentrations and selects, via the user interface, the applicable glycol percentage from the presented list. The controller then utilizes the $C_p$ and Prt values associated in memory with the selected glycol level in in the equations described herein to define burner firing rate corresponding to coolant flow rate. The Prt values themselves are within the manufacturers (or, possibly, the operator's) discretion, based on testing under varying flow and other system conditions, measuring component heat stress over the tests. Based on the test results, the manufacturer can, for each of various combinations of system conditions, select a modification to the basic firing rate/coolant flow rate relationship (which, in the examples described herein, is based on the linear DT/coolant flow rate relationship as described above) that achieves an acceptable heat stress performance under the corresponding system condition set, determine the Prt value that results in that firing rate/coolant flow rate relationship, and store the selected Prt values in association with the corresponding coolant/glycol concentrations in the controller memory for later selection by the operator. Accordingly, it will be understood that the selection of Prt values is within the discretion of the manufacturer (or the operator, where the controller application provides the operator ability to modify Prt values) depending on the boiler's configuration and the environment in which the boiler is expected to be used.

In an example embodiment, the controller may utilize additional algorithms to provide various protection mechanisms for the operation of heat exchanger 100. The protection mechanisms operate around both the monitored DT of the heat exchanger and a general maximum allowable DT (DTmax). DTmax is a value defined by the manufacturer, e.g. through testing, as the level of DT at which, if reached by the boiler, damage to boiler components begins immediately or within a short period of time. It is the DT value at which the burner should be immediately deactivated. DTmax is, therefore, greater than DT@maxRate (which is a DT value that may be achieved within the boiler's normal operation), and in certain embodiments is within a range of 1° F.-5° F. higher than DT@maxRate, e.g. 3° F. higher than DT@maxRate. The manufacturer may select DTmax in the manufacturer's discretion based on boiler testing to determine the DT rate at which unacceptable heat stress levels occur within certain predetermined time periods (also within the manufacturer's discretion).

Figure 6:
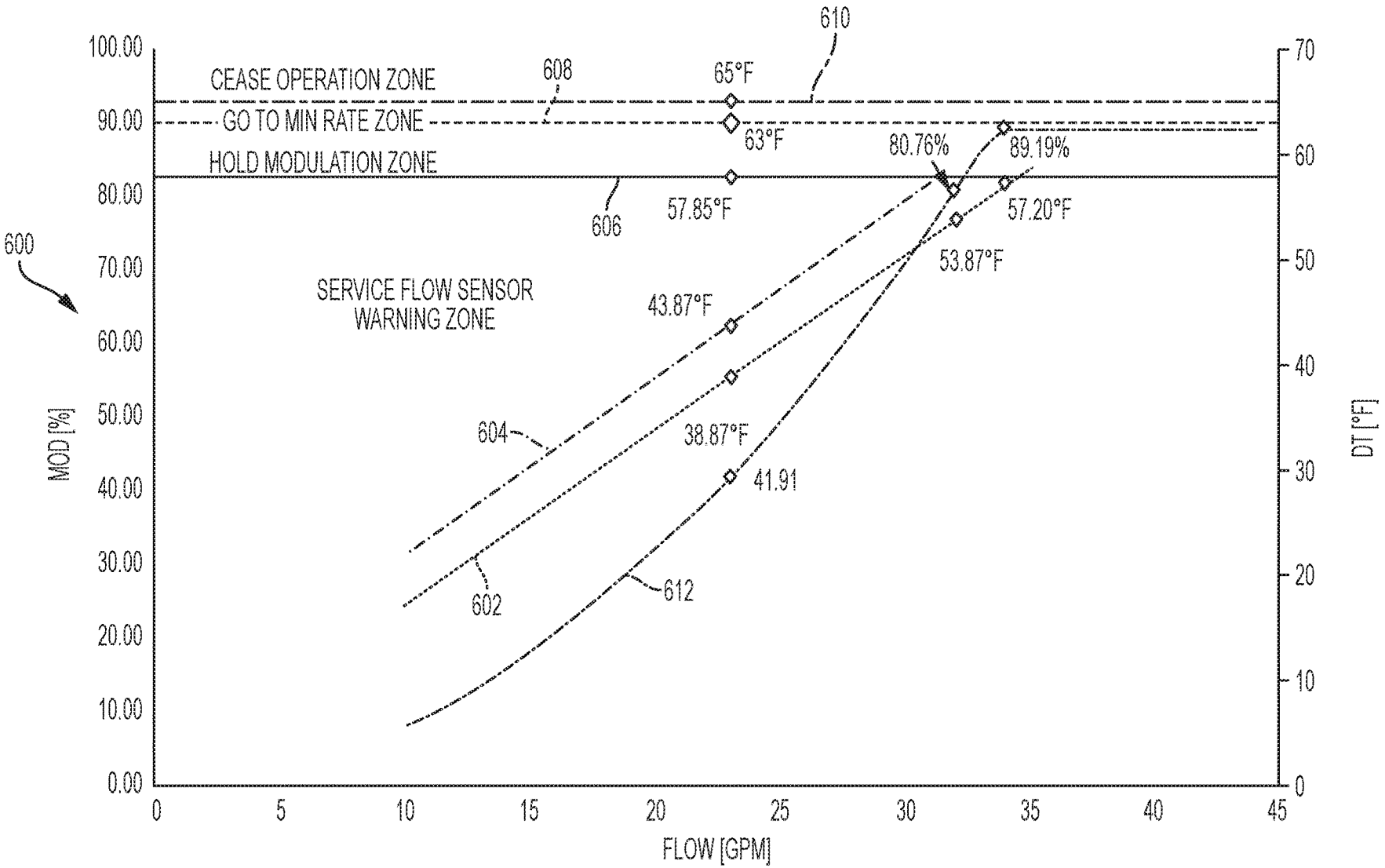
FIG. 6 illustrates a graph of percent modification of input rate and differential temperatures as a function of coolant flow, according to an example embodiment.

In operation, controller 722 (FIG. 7) monitors the signals output by temperature sensors 148 (FIGS. 1 and 7) and determines therefrom the temperature of coolant entering the heat exchanger and temperature of coolant exiting the heat exchanger and, thereby, determines the actual DT. As discussed above, the controller also uses Eqn. 4 (directly or by a lookup table defined at calibration) to simultaneously determine the target DT at that moment as a function of coolant flow rate through heat exchanger 100, as represented by line 602 in graph 600 of FIG. 6. By adding an offset to the target DT (line 602), the controller determines a threshold function with a slope parallel to that of line 602, represented by line 604, that defines a "Flow Sensor Warning Zone" (FSWZ, which in this example is the area within graph 600 left of line 604, or the graph space on the side of line 604 opposite line 602). The equation for determining the FSWZ threshold in this example is $$\text{FSWZ threshold}=(\text{Eqn. 4})+\text{DT offset}[^\circ\text{ F.}] \qquad \text{Eqn. 6}$$

where the DT offset may be entered and adjusted by an operator via user interface 726 (FIG. 7). In one example DT offset=5.0° F.

If the controller detects an actual DT on the opposite side of line 604 from line 602 at a given coolant flow rate, the controller outputs a signal to user interface 726 (FIG. 7), or to another warning device (for example an LED disposed on the boiler or other heat exchanger outer housing expected to be within the operator's view), causing the user interface or other device to display a warning to the operator. This condition indicates to the operator that the boiler or other heat exchanger may be experiencing a flow rate lower than that reported by flow sensor 142 (FIGS. 1 and 7), thereby notifying the operator that the flow sensor may be damaged or otherwise in need of service or replacement. The condition may also arise from sediment buildup within the coolant flow path through the heat exchanger that reaches a level sufficient to significantly restrict coolant flow.

The controller operation (e.g. as defined by the instructions of its programming) may also provide a "Hold Modulation Zone" (HMZ) protection mechanism, in which the controller will maintain the burner firing rate constant when and as long as the DT of the heat exchanger exceeds an HMZ threshold, represented by line 606 in graph 600. Again in response to detection of actual DT from the output signals of sensors 148, the controller will hold the firing rate constant, regardless of both the observed flow readings provided by the flow sensors and the heat demand received by the controller from remote device 732, if the actual DT detected by sensors 148 (FIGS. 1 and 7) is greater than the HMZ threshold. The controller thus attempts to return the actual DT to within the FSWZ and, ultimately, the target level of operation as defined by line 602. The equations for determining the HMZ threshold temperature are $$\text{HMZ threshold}=\text{DTmax}-5.0^\circ\text{ F.} \qquad \text{Eqn. 7a}$$

when the operating fluid of the heat exchanger is 100% water, and $$\text{HMZ threshold}=\text{DTmax}*Cp \qquad \text{Eqn. 7b}$$

if the operating fluid of the heat exchanger has a non-zero concentration of propylene or ethylene glycol. Once the DT of the heat exchanger moves back below the HMZ threshold (line 606), the controller begins to operate the heat exchanger in accordance with the normal algorithm for governing its operation, as discussed herein.

The controller operation may also provide a "Minimum Firing Rate Zone" (MFRZ) protection mechanism, in which the controller will reduce the heat exchanger firing rate in order to reduce the DT. The MFRZ threshold is represented by line 608 in graph 600. Since the MFRZ threshold is higher than line 604 and the HMZ threshold, a heat exchanger, such as boilers as discussed herein, reaches the MFRZ threshold only after those earlier protection mechanisms have failed to bring DT back into alignment with line 602. Regardless of the operational input signals the controller otherwise receives, such as the flow rate signals provided by the flow sensor 142 (FIGS. 1 and 7) or heat demand from remote device 732 such as a thermostat, the controller will, in response to DT reaching the MFRZ threshold as reflected by the signals from temperature sensors 148 (FIGS. 1 and 7), reduce the heat exchanger burner's firing rate to the burner's rated minimum firing rate. The equation for determining the MFRZ threshold temperature is $$\text{MFRZ threshold} = \text{DTmax} - 2.0^\circ \text{ F.} \quad \text{Eqn. 8}$$

Note, the value of 2.0° F. is a design parameter, and other values may be selected in alternate embodiments. If the controller succeeds in reducing the value of DT during operation in the MFRZ, and actual DT returns below the MFRZ threshold temperature, thereby re-entering the HMZ, the controller will modulate the firing rate of the heat exchanger in accordance with the operational criteria of the HMZ, discussed above.

If the previously discussed protection mechanisms fail to reduce the boiler's DT, and actual DT passes through and beyond the MFRZ threshold 608, a "Cease Operation Zone" (COZ) is provided. The threshold DT for entering the COZ is the value of DTmax, represented by line 610 of graph 600. If the boiler's actual DT exceeds DTmax, the controller deactivates the boiler (in certain embodiments, deactivating the boiler can be considered at least deactivating the boiler's burner) to prevent further increase in the observed value of DT. The controller continues to monitor DT following the deactivation and attempts to reactivate the burner when DT reaches one-half of DTmax. Thus, e.g., if DTmax=80° F., the unit ceases operation when detected DT is at or greater than 80.1° F. The unit remains inactive until detected DT is at or below 40° F., at which point the controller re-ignites the burner, resets the error condition, and begins normal cycling of the boiler.

Referring again to FIG. 6, graph 600 illustrates an example of the operation of a heat exchanger (e.g. a fire-tube boiler) in accordance with the previously discussed protective mechanisms provided by an example controller. In the illustrated embodiment, the boiler operates at a firing rate of 41.91 percent (the burner is operating at 41.91% of its maximum capacity); the coolant flow rate through the heat exchanger is 23 gpm; and the operating fluid is a solution of water and glycol (thirty percent glycol concentration). For the noted heat exchanger operating conditions and design parameters, the controller determines the maximum operational DT (line 602) by Equation 4. As calculated, the maximum operational DT at 23 gpm and a firing rate of 41.91 percent is 38.87° F.

As previously discussed, the controller determines the FSWZ threshold temperature using Equation 6, during the boiler system's calibration. In the example embodiment, the DToffset value selected is the default value of 5.0° F. As such, if a flow rate of 23 gpm and firing rate of 41.91 percent is maintained, the DT will enter the FSWZ when DT exceeds 43.87° F. Upon DT entering the FSWZ, the controller provides a flow warning to the user interface at 726 or 732 (FIG. 7), but the controller continues to allow operation of the heat exchanger at the firing rate of 41.91 percent.

Assuming DT continues to rise, such that DT passes through the FSWZ and eventually reaches the HMZ threshold 606, which the controller determines using Equation 7b since the operating fluid of the heat exchanger is a water-glycol solution, then upon the DT reaching the HMZ threshold of 57.85° F., the controller will not allow the firing rate to increase regardless of the observed flow measured by the flow sensors or any heat demand signal from a thermostat or other device. Thus, the burner's firing rate holds steady. The controller does not thereafter allow the firing rate to be governed by the normal operating algorithms until DT drops below the HMZ threshold by a given amount, such as by 1.0° F. in the example embodiment. In some instances, this condition occurs because coolant flow through the boiler has not yet begun, despite an indication of flow from the flow sensor, or because flow is lower than the flow rate the sensor signal indicates, in either case indicating a sensor malfunction. Thus, in holding the burner's firing rate constant until DT decreases, the controller keeps the firing rate from driving DT still higher until actual flow through the heat exchanger occurs or reaches the desired level, regardless of the flow data provided by the flow sensor or of heat demand signals.

If the previous actions by the controller fail to prevent the DT from increasing further, DT will eventually reach the MFRZ threshold 608 of 63.0° F., as determined by the controller using Equation 8. Upon the DT reaching the MFRZ threshold, the controller reduces the burner's firing rate to the burner's predetermined rated minimum firing rate, regardless of the flow data provided by the flow sensor. If the DT begins to decrease once the controller reduces the firing rate, the DT will now be in the HMZ as the system will have successfully achieved an operational equilibrium point. Once the DT is in the HMZ, the controller will once again not allow the firing rate to increase until the DT is reduced further (in this example, the DT re-enters the FSWZ).

If, however, the previously described actions are not successful, and the DT continues to increase and reach the COZ threshold (the design DTmax), the controller deactivates the burner to reduce the DT.

Example Processing Circuitry

FIG. 7, and also with reference to FIG. 1, illustrates certain elements of a controller for a heat exchanger, e.g. a boiler 100. The controller of FIG. 7 may be employed, for example, as on-board circuitry associated locally to control the heat exchanger (and may, e.g., be mounted to the heat exchanger itself), but may also be included as part of a remote user device (e.g. a remote control device that wirelessly communicates with control circuiting local to the heat exchanger), or a general purpose computer or other computer system that communicates with the heat exchanger's local circuitry via a wireless as wired local or wide area network, to thereby control the local circuitry's control of the heat exchanger's operation. Alternatively, embodiments may be employed on a combination of devices. Accordingly, some embodiments of a controller 700 may be embodied wholly at a single device or by devices in a client/server relationship. Furthermore, it should be noted that the devices or elements described below may not be mandatory and, thus, some may be omitted in certain embodiments.

In an example embodiment, the controller may include or otherwise be in communication with processing circuitry 720 that is configured to perform data processing, application execution and other processing and management services according to an example embodiment of the present invention. In one embodiment, processing circuitry 720 may include a memory 724 and a processor 722 that may be in communication with or otherwise control a user interface 726 and a communication interface 728. As such, processing circuitry 720 may be embodied as a circuit chip (e.g. an integrated circuit chip) configured (e.g. with hardware, software or a combination of hardware and software) to perform operations described herein. However, in some embodiments, processing circuitry 720 may be embodied as a portion of a server, computer, laptop, workstation or even one of various mobile computing devices or wearable computing devices. In situations where processing circuitry 720 is embodied as a server or at a remotely located computing device, user interface 726 may be disposed at another device (e.g. at a computer terminal or client device) that may be in communication with processing circuitry 720 via device interface 728 and/or a network 716).

User interface 726 may be an input/output device for receiving instructions directly from a user. User interface 726 may be in communication with processing circuitry 720 to receive user input via user interface 726 and/or to present output to a user as, for example, audible, visual, mechanical or other output indications. User interface 726 may include, for example, a keyboard, a mouse, a joystick, a display (e.g. a touch screen display), a microphone, a speaker, or other input/output mechanisms. Further, processing circuitry 720 may comprise, or be in communication with, user interface circuitry configured to control at least some functions of one or more elements of user interface 726. Processing circuitry 720 and/or user interface circuitry may be configured to control one or more functions of one or more elements of user interface 726 through computer program instructions (e.g. software and/or firmware) stored on a memory device accessible to processing circuitry 720 (e.g. volatile memory, non-volatile memory, and/or the like). In some example embodiments, user interface 726 is configured to facilitate user control of at least some functions of the apparatus through the use of a display configured to respond to user inputs. Processing circuitry 720 may also comprise, or be in communication with, display circuitry configured to display at least a portion of a user interface 726, the display and the display circuitry configured to facilitate user control of at least some functions of the apparatus.

Communication interface 728 may be any means, such as a device or circuitry embodied in hardware, software, or a combination of hardware and software, that is configured to receive and/or transmit data from/to a network and/or any other device or module in communication with the apparatus. Communication interface 728 may, for example, facilitate communication between processing circuitry 720/processor 722 and remote device 732. Communication interface 728 may also include, for example, an antenna (or multiple antennas) and supporting hardware and/or software for enabling communications with network 716 or other devices. In some environments, communication interface 728 may alternatively or additionally support wired communication. As such, for example, communication interface 728 may include a communication modem and/or other hardware/software for supporting communication via cable, digital subscriber line (DSL), universal serial bus (USB) or other mechanisms. In an exemplary embodiment, communication interface 728 may support communication via one or more different communication protocols or methods. In some cases, IEEE 802.15.4 based communication techniques such as WiFi or other low power, short or long range communication protocols, such as a proprietary technique based on IEEE 802.15.4, may be employed along with radio frequency identification (RFID) or other short range communication techniques. In other embodiments, communication protocols based on the draft IEEE 802.15.4a standard may be established.

In an example embodiment, memory 724 may include one or more non-transitory storage or memory devices such as, for example, volatile and/or non-volatile memory that may be either fixed or removable. Memory 724 may be configured to store information, data, applications, instructions or the like for enabling the apparatus to carry out various functions in accordance with example embodiments of the present invention among other operational features (including diagnostic information, fault reporting, etc.). For example, memory 724 could be configured to buffer input data for processing by processor 722. Additionally or alternatively, memory 724 could be configured to store instructions (e.g. to effect the functions performed by the controller as described herein) for execution by processor 722. As yet another alternative, memory 724 may include one of a plurality of databases that may store a variety of files, contents, or data sets. Among the contents of memory 724, applications may be stored for execution by processor 722 in order to carry out the functionality associated with each respective application.

Processor 722 may be embodied in a number of different ways, for example as various processing means such as a microprocessor or other processing element, a coprocessor, a controller or various other computing or processing devices including integrated circuits such as, for example, an ASIC (application specific integrated circuit), an FPGA (field programmable gate array), a hardware accelerator, or the like. In an example embodiment, processor 722 may be configured to execute instructions stored in memory 724 or otherwise accessible to processor 722. As such, whether configured by hardware or software methods, or by a combination thereof, processor 722 may represent an entity (e.g. physically embodied in circuitry) capable of performing operations according to embodiments of the present invention while configured accordingly. Thus, for example, when processor 722 is embodied as an ASIC, FPGA or the like, processor 722 may be specifically configured hardware for conducting the operations described herein. Alternatively, as another example, when processor 722 is embodied as an executor of software instructions, the instructions may specifically configure processor 722 to perform the operations described herein.

In an example embodiment, processing circuitry 720 may include or otherwise be in communication with two or more temperature sensors 148. As described above with respect to FIG. 1, temperature sensors 148 may be respectively disposed at inlet 108 and outlet 110 of heat exchanger 100 so that temperature sensors 148 output signals that define temperature data to processor 722, where the temperature data is indicative of a temperature of the coolant at inlet 108 and outlet 110, respectively. Temperature sensors 148 may include one or more of a thermistor, a thermocouple, a resistance thermometer, or the like.

In some example embodiments, processing circuitry 720 may include or otherwise be in communication with a flow sensor 142. As described above with respect to FIG. 1, flow sensor 142 may be disposed at inlet 108 of heat exchanger 100 so that the flow sensor outputs a signal that provides processing circuitry 720 with flow rate data indicative of the flow rate of the coolant through the coolant system. One of ordinary skill in the art would immediately appreciate that flow sensor 142 may be disposed in a position in the coolant system that is hydraulically closed with the heat exchanger, such that the flow detected at flow sensor 142 is substantially similar to the flow through heat exchanger 100. Flow sensor 142 may include one or more of an orifice flow sensor, a venturi flow sensor, a nozzle flow sensor, a rotameter, pitot tubes, calorimetrics, a turbine flow sensor, a vortex flow sensor, an electromagnetic flow sensor, a Doppler flow sensor, an ultrasonic flow sensor, a thermal flow sensor, a Coriolis flow sensor, or the like. In an example embodiment, in which two or more flow sensors are employed to sense a total flow across the heat exchanger, for example a flow sensor at each of multiple inlets 108, the processing circuitry may sum the measured flow to determine a total flow into the heat exchanger 100.

Still referring to FIGS. 1 and 7, processing circuitry 720, and in particular processor 722, may be in communication with burner 134 to control the burner's operation and, in particular, its firing rate. For example, processor 722 may output a signal (indicated at 730) that is received by a relay (not shown) that selectively electrically connects a power source (e.g. mains power or a battery or other electrical storage device) to a solenoid gas valve (not shown) in a gas supply line that feeds fuel gas to the burner. For example, burner 134 may be a premix burner, in which a valve in the gas supply conduit line, upstream from the surface of burner 134 at which combustion occurs, controls the flow of fuel gas to the burner surface. A venturi structure between the valve and the burner surface is open to an air source, e.g. the air ambient to the boiler or other heat exchanger, so that gas flow from the valve and through the venturi structure draws air into the venturi and, thereby, into the gas flow. The gas pressure, and/or a blower located upstream or downstream from the burner, pushes and/or pulls the air and gas mixture through the gas line and a mixing chamber to the burner surface. As this occurs, processor 722 actuates an electrical igniter (again, through control of a switch in the electrical line between the power source and the igniter) disposed proximate the burner surface to thereby ignite the air/gas mixture as it flows through the burner surface. Thereafter, a flame sensor, also disposed proximate the burner surface, detects the existence of the flame and outputs a corresponding signal to processor 722. Once having ignited the air/gas mixture at the burner surface, processor 722 monitors the output of the flame sensor and maintains the gas valve in its open state as long as the signal indicates presence of a flame and the processor continues to have instructions from remote device 732 (e.g. a thermostat) or interface 726 demanding heated coolant. If, for example, (a) the flame detector signal state changes, indicating that the flame has extinguished, (b) the processor receives a signal from device 732 or device 726 indicating heated coolant is no longer needed, or (c) the processor receives a signal from the downstream temperature sensor 148 indicating that coolant temperature has reached the target temperature, processor 722 changes the signal output to the relay so that the relay, in turn, disengages the solenoid fuel valve from the power source, thereby causing the fuel valve to close and interrupting the flow of fuel gas to the burner. In other embodiments, in which the burner is a non-premix type, the processor similarly controls the burner via control of a fuel valve through a relay, but instead of a venturi to draw air into the fuel gas flow before reaching the burner, the gas flows directly to the burner surface, at which the gas mixes with air allowed into the burner area through vents to the exterior.

Controller 720, and in particular processor 722, controls the burner's firing rate through control of blower 136. More specifically, processor 722 controls the operation of a variable speed motor (not shown separately from blower 136) via a relay operatively disposed in the electrical connection between the variable speed motor and the power source or by directing a signal directly to a control input port at the motor. In either instance, processor 722 actuates the relay, and therefore the fan motor indirectly, or the fan motor directly via the control input port, intermittently over a predetermined period of time in a pulse width modulation control to thereby operate the fan at a controllable percentage of its maximum speed. Because the blower controls the draw of fuel gas to the burner surface, blower speed corresponds directly with the amount of fuel burned at the burner and, thus, the burner's firing rate. Control of blower speed is, therefore, control of burner firing rate. Thus, for example, to control the fuel flow to the burner surface to half that of its maximum flow rate, and thereby control the burner to half its maximum firing rate, processor 722 alternates the input signal to the relay or the blower motor's control input between maximum and zero PWM output so that the blower is actuated at 50% of its maximum. Accordingly, as the processor determines the target firing rate as discussed above, it controls the pulse width modulation of its control signal to the blower to a level to achieve the fan speed to operate the burner at the target firing rate.

Example Flowchart(s) and Operations

Figure 8:
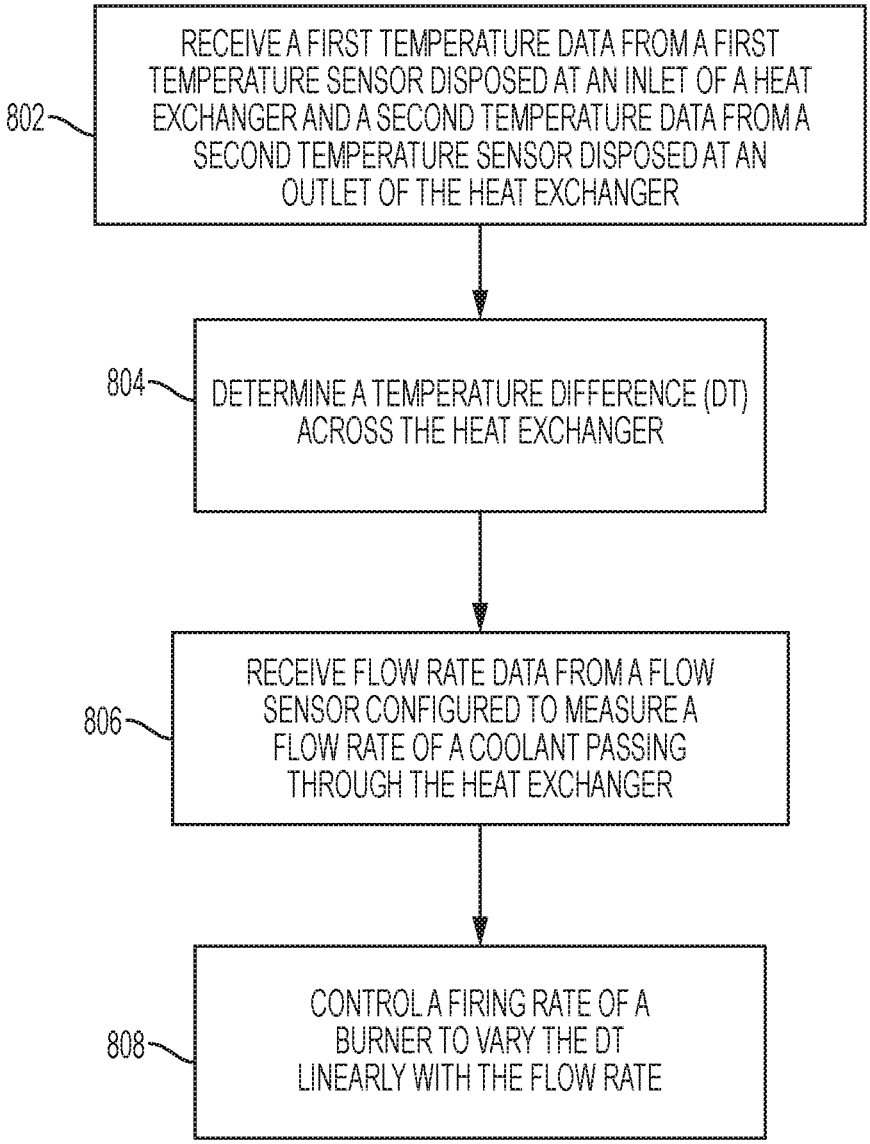
FIG. 8 illustrates a method of controlling firing rate of a burner in a heat exchanger according to an example embodiment.

FIG. 8 provides a flowchart illustrating an example method for controlling firing rate of a burner into a heat exchanger according to an example embodiment. The operations illustrated in and described with respect to FIG. 8 may, for example, be performed by, with the assistance of, and/or under the control of one or more of the processor 722, memory 724, communication interface 728, and/or user interface 724, each illustrated in FIG. 7. The method may include receiving a first temperature data from a first temperature sensor deposed at an inlet to a heat exchanger and a second temperature data from a second temperature sensor disposed at an outlet of the heat exchanger at operation 802 and determining an actual differential temperature across the heat exchanger at operation 804, for use in assessing the protection mechanisms, for example as described herein. The method may also include receiving flow rate data from a flow sensor configured to measure a flow rate of a coolant passing through the heat exchanger at operation 806 and controlling a firing rate of a burner based on a linear relationship between DT and coolant flow rate, as described above with respect to Equations 1-5, as indicated at 808. In some embodiments, the method may include additional, optional operations, and/or the operations described above may be modified or augmented, as described above with respect to FIG. 6.

FIG. 8 illustrates a flowchart of a system, method, and computer program product according to an example embodiment. It will be understood that each block of the flowcharts, and combinations of blocks in the flowcharts, may be implemented by various means, such as hardware and/or a computer program product comprising one or more computer-readable media having computer readable program instructions stored thereon. For example, one or more of the procedures described herein may be embodied by computer program instructions of a computer program product. In this regard, the computer program product(s) that embody the procedures described herein may be stored by, for example, memory 724 and executed by, for example, processor 722, with reference to FIG. 7. As will be appreciated, any such computer program product may be loaded onto a computer or other programmable apparatus to produce a machine, such that the computer program product including the instructions which execute on the computer or other programmable apparatus creates means for implementing the functions specified in the flowchart block(s). Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowchart block(s).

In some embodiments, the system may be further configured for additional operations or optional modifications. In this regard, in an example embodiment, the processing circuitry is further configured to control the firing rate based on a linear relationship between DT and coolant flow rate. In an example embodiment, the processing circuitry is further configured to prevent burner ignition below a minimum flow rate at initial ignition. In some example embodiments, the DT at ignition is calculated as $$\text{DT@Ignition}=\text{Input@Ignition}*\text{Eff}/8.3207*60*C_p*\text{MinFlow@Ignition},$$

In an example embodiment, a slope of DT between the minimum flow rate and the maximum firing rate is calculated as $$DT=\left(\frac{DT@maxRate-DT@\text{Ignition}}{MinFlow@maxRate-MinFlow@\text{Ignition}}\right)*(\text{Flow}-MinFlow@\text{Ignition})+DT@\text{Ignition}$$

In some example embodiments, the heat exchanger comprises a portion of a fire tube boiler. In an example embodiment, the processing circuitry is further configured to control the firing rate based on a specific heat of the coolant. In some example embodiments, the firing rate is a percentage of input rate, calculated as $$InputRate=\frac{8.3207*60*C_p*DT*\text{FLOW}*Prt}{Eff}.$$

In an example embodiment, the coolant comprises a water/glycol solution. In some example embodiments, the coolant comprises less than about 50% glycol.

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. A heat exchanger system, comprising:

a burner configured to burn a combustible gas to produce heat;

a heat exchanger configured to receive the heat from the burner and transfer the heat to a coolant flowing through the heat exchanger;

a flow sensor disposed with respect to the heat exchanger to measure flow rate of the coolant through the heat exchanger; and a controller comprising processing circuitry, wherein the processing circuitry is configured to receive data from the flow sensor indicative of the flow rate, and after an initial ignition of the burner, control a firing rate of the burner based on a predetermined relationship between a temperature difference of the coolant across predetermined positions in the coolant's flow path through the heat exchanger (DT) and the flow rate, in which DT varies with the flow rate and the firing rate of the burner is controlled to maintain the DT at or below a maximum DT, the maximum DT being lower than a predetermined threshold DT likely to cause damage to the heat exchanger.

2. The heat exchanger system of claim 1, wherein the predetermined relationship is linear.

3. The heat exchanger system as in claim 1, wherein the predetermined relationship is based on an efficiency of the heat exchanger, a first predetermined heat input rate to the heat exchanger at a first predetermined flow rate of the coolant, and a second predetermined heat input rate to the heat exchanger at a second predetermined flow rate of the coolant.

4. The heat exchanger system of claim 3, wherein the first predetermined heat input rate corresponds to a DT at initial ignition of the heat exchanger and the first predetermined flow rate is a predetermined flow rate of the coolant through the heat exchanger at the initial ignition.

5. The heat exchanger system of claim 4, wherein the processing circuitry is further configured to prevent burner ignition in absence of at least a predetermined minimum flow rate of the coolant at the initial ignition.

6. The heat exchanger system of claim 4, wherein the second predetermined heat input rate corresponds to a DT at a maximum flow rate of the coolant through the heat exchanger and the second predetermined flow rate is the maximum flow rate.

7. The heat exchanger system of claim 6, wherein the second predetermined heat input rate and the second predetermined flow rate are related at least in part as $$MinFlow@maxRate[\text{gpm}]=\text{Input}\left[\frac{\text{BTU}}{\text{hr}}\right]*Eff\Big/8.3207\left[\frac{\text{lb}}{\text{g}}\right]*60\left[\frac{\text{min}}{\text{h}}\right]*Cp\left[\frac{\text{BTU}}{\text{lb}\ ^\circ\text{F.}}\right]*DT@maxRate[^\circ\text{F.}],$$

where MinFlow@maxRate is the second predetermined flow rate, Input is the second predetermined heat input rate, $C_p$ is a specific heat of the coolant, and DT@maxRate is a predetermined maximum DT when the coolant flows through the heat exchanger at the maximum flow rate.

8. The heat exchanger system of claim 6, wherein a value corresponding to the DT at a maximum flow rate of the coolant through the heat exchanger can be configured by a user.

9. The heat exchanger system of claim 4, wherein the DT at initial ignition (DT@Ignition) is related to the first predetermined heat input rate and the first predetermined flow rate at least in part as $$\text{DT@Ignition}=\text{Input@Ignition}*\text{Eff}/8.3207*60*C_p*\text{MinFlow@Ignition},$$

where Eff is a predetermined efficiency of the heat exchanger, Input@Ignition is the first predetermined heat input rate, MinFlow @Ignition is the first predetermined flow rate, and $C_p$ is a specific heat of the coolant.

10. The heat exchanger system of claim 4, wherein the second predetermined heat input rate corresponds to a DT at a maximum flow rate of coolant through the heat exchanger and the second predetermined flow rate is the maximum flow rate, and wherein the predetermined relationship comprises $$DT = \left(\frac{DT@\max Rate - DT@\text{Ignition}}{\text{Min}Flow@\max Rate - \text{Min}Flow@\text{Ignition}}\right) * (\text{Flow} - \text{Min}Flow@\text{Ignition}) + DT@\text{Ignition},$$

where DT@maxRate is the DT at the maximum flow rate, DT@Ignition is the DT at initial ignition, MinFlow@Ignition is the predetermined flow rate of the coolant through the heat exchanger at the initial ignition, MinFlow@maxRate is the maximum flow rate, and Flow is the flow rate.

11. The heat exchanger system of claim 1, wherein the heat exchanger comprises a portion of a fire tube boiler.

12. The heat exchanger system of claim 1, wherein the predetermined relationship is based on a specific heat of the coolant.

13. The heat exchanger system of claim 1, wherein a target firing rate of the burner controlled by the controller is based upon a relationship between an input rate of the burner and the flow rate comprising $$InputRate = \frac{8.3207 * 60 * Cp * DT * \text{Flow}}{Eff},$$

where InputRate is a target heat input rate of the heat exchanger, $C_p$ is a specific heat of the coolant, Flow is the flow rate of the coolant in the predetermined relationship, and Eff is efficiency of the heat exchanger.

14. The heat exchanger system of claim 1, wherein the coolant comprises a water and glycol mixture solution.

15. The heat exchanger system as in claim 1, further comprising a first temperature sensor in a flow path of the coolant through the heat exchanger and a second temperature sensor in the flow path, wherein the processing circuitry is configured to receive signals from the first and second temperature sensors indicative of coolant temperature, wherein the signals from the first and second temperature sensors define an actual DT.

16. The heat exchanger system as in claim 15, wherein the processing circuitry is configured to control the firing rate at a constant level for a period while the actual DT is above a first threshold value.

17. The heat exchanger system as in claim 16, wherein the processing circuitry is configured to control the firing rate to a predetermined level below the constant level while the actual DT is above a second threshold value greater than the first threshold value.

18. A method of controlling operation of a heat exchanger system having a burner configured to burn a combustible gas to produce heat, a heat exchanger configured to receive the heat from the burner and transfer the heat to a coolant flowing through the heat exchanger, and a flow sensor disposed with respect to the heat exchanger to measure flow rate of the coolant through the heat exchanger, said method comprising the steps of:

receiving data from the flow sensor indicative of the flow rate, and after an initial ignition of the burner, controlling a firing rate of the burner based on a predetermined relationship between a temperature difference of the coolant across predetermined positions in the coolant's flow path through the heat exchanger (DT) and the flow rate, in which DT varies with the flow rate and the firing rate of the burner is controlled to maintain the DT at or below a maximum DT, the maximum DT being lower than a predetermined threshold DT likely to cause damage to the heat exchanger.

19. The method as in claim 18, wherein the predetermined relationship is linear.

20. The method as in claim 19, comprising the step of selecting a slope of the predetermined relationship.

21. The method as in claim 18, wherein the predetermined relationship is based on an efficiency of the heat exchanger, a first predetermined heat input rate to the heat exchanger at a first predetermined flow rate of the coolant, and a second predetermined heat input rate to the heat exchanger at a second predetermined flow rate of the coolant.

22. The method as in claim 21, wherein the first predetermined heat input rate corresponds to a DT at initial ignition of the heat exchanger and the first predetermined flow rate is a predetermined flow rate of the coolant through the heat exchanger at the initial ignition.

23. The method as in claim 22, further comprising the step of preventing burner ignition in absence of at least a predetermined minimum flow rate of the coolant at the initial ignition.

24. The method as in claim 22, wherein the second predetermined heat input rate corresponds to a DT at a maximum flow rate of the coolant through the heat exchanger and the second predetermined flow rate is the maximum flow rate.

25. The method as in claim 24, wherein the second predetermined heat input rate and the second predetermined flow rate are related at least in part as $$\text{Min}Flow@\max Rate[gpm] = \text{Input}\left[\frac{\text{BTU}}{hr}\right] * Eff \Big/ 8.3207\left[\frac{\text{lb}}{\text{g}}\right] * 60\left[\frac{\text{min}}{\text{h}}\right] * Cp\left[\frac{\text{BTU}}{\text{lb}^\circ\text{ F.}}\right] * DT@\max Rate[^\circ\text{ F.}],$$

where MinFlow @maxRate is the second predetermined flow rate, Input is the second predetermined heat input rate, $C_p$ is a specific heat of the coolant, and DT@maxRate is a predetermined maximum DT when the coolant flows through the heat exchanger at the maximum flow rate.

26. The method as in claim 22, wherein the DT at initial ignition (DT@Ignition) is related to the first predetermined heat input rate and the first predetermined flow rate at least in part as $$\text{DT@Ignition} = \text{Input@Ignition} * \text{Eff}/8.3207 * 60 * Cp * \text{MinFlow@ignition},$$

where Eff is a predetermined efficiency of the heat exchanger, Input@Ignition is the first predetermined heat input rate, MinFlow@Ignition is the first predetermined flow rate, and $C_p$ is a specific heat of the coolant.

27. The method as in claim 22, wherein the second predetermined heat input rate corresponds to a DT at a maximum flow rate of the coolant through the heat exchanger and the second predetermined flow rate is the maximum flow rate, and wherein the predetermined relationship comprises $$DT = \left(\frac{DT@\max Rate - DT@\text{Ignition}}{\text{Min}Flow@\max Rate - \text{Min}Flow@\text{Ignition}}\right) * (\text{Flow} - \text{Min}Flow@\text{Ignition}) + DT@\text{Ignition},$$

where DT@maxRate is the DT at the maximum flow rate, DT@Ignition is the DT at initial ignition, MinFlow @Ignition is the predetermined flow rate of the coolant through the heat exchanger at the initial ignition, MinFlow@maxRate is the maximum flow rate, and Flow is the flow rate.

28. The method as in claim 18, wherein the predetermined relationship is based on a specific heat of the coolant.

29. The method as in claim 18, wherein a target firing rate to which the firing rate is controlled in the controlling step is based upon a relationship between an input rate of the burner and the flow rate comprising $$InputRate = \frac{8.3207 * 60 * Cp * DT * \text{Flow}}{Eff},$$

where InputRate is a target heat input rate of the heat exchanger, $C_p$ is a specific heat of the coolant, Flow is the flow rate of the coolant in the linear relationship, and Eff is efficiency of the heat exchanger.

30. The method as in claim 18, comprising the step of selecting the predetermined relationship.

* * * * *